US007699444B2

(12) United States Patent
Takahashi

(10) Patent No.: US 7,699,444 B2
(45) Date of Patent: Apr. 20, 2010

(54) LIQUID DROPLET-JETTING APPARATUS AND METHOD FOR PRODUCING LIQUID DROPLET-JETTING APPARATUS

(75) Inventor: Yoshikazu Takahashi, Nagoya (JP)

(73) Assignee: Brother Kogyo Kabushiki Kaisha, Aichi-Shi (JP)

( * ) Notice: Subject to any disclaimer, the term of this patent is extended or adjusted under 35 U.S.C. 154(b) by 465 days.

(21) Appl. No.: 11/888,208

(22) Filed: Jul. 31, 2007

(65) Prior Publication Data

US 2008/0030553 A1 Feb. 7, 2008

(30) Foreign Application Priority Data

Aug. 1, 2006 (JP) ..... 2006-210248

(51) Int. Cl.
*B41J 2/045* (2006.01)

(52) U.S. Cl. ..... 347/70; 347/68

(58) Field of Classification Search ..... 347/70, 347/68–69, 71–72; 400/124.14–124.16; 310/363–366

See application file for complete search history.

(56) References Cited

U.S. PATENT DOCUMENTS 5,898,448 A 4/1999 Ishikawa
7,527,363 B2 * 5/2009 Nagashima ..... 347/70
7,591,542 B2 * 9/2009 Sugahara ..... 347/68
7,625,074 B2 * 12/2009 Takahashi et al. ..... 347/68
2005/0068377 A1 3/2005 Ishikawa et al.
2005/0259135 A1 11/2005 Mita et al.
2005/0285911 A1 12/2005 Sugahara
2006/0181582 A1 8/2006 Sugahara
2006/0262167 A1 11/2006 Sugahara

FOREIGN PATENT DOCUMENTS

JP 8281948 10/1996
JP 2005104038 4/2005
JP 2006321174 11/2006

* cited by examiner

*Primary Examiner*—K. Feggins
(74) *Attorney, Agent, or Firm*—Eugene Ledonne; Joseph W. Treloar; Frommer Lawrence & Haug

(57) ABSTRACT

A channel unit has a first individual ink channel including a first nozzle and a first pressure chamber, and a second individual ink channel including a second nozzle and a second pressure chamber. The channels have a mutually identical channel structure. A piezoelectric actuator, in which a vibration plate, a piezoelectric layer, and a pair of electrodes are stacked, is arranged on the upper surface of the channel unit. A portion of the piezoelectric layer facing the first pressure chamber is thinner than a portion facing the second pressure chamber. Accordingly, a liquid droplet-jetting apparatus is provided, in which the channel structure is simple, and the volumes of liquid droplets jetted from the first nozzle and the second nozzle respectively are different from each other.

24 Claims, 20 Drawing Sheets

LIQUID DROPLET-JETTING APPARATUS AND METHOD FOR PRODUCING LIQUID DROPLET-JETTING APPARATUS

CROSS REFERENCE TO RELATED APPLICATION

The present application claims priority from Japanese Patent Application No. 2006-210248, filed on Aug. 1, 2006, the disclosure of which is incorporated herein by reference in its entirety.

BACKGROUND OF THE INVENTION

1. Field of the Invention

The present invention relates to a liquid droplet-jetting apparatus which jets liquid droplets from nozzles, and a method for producing the liquid droplet-jetting apparatus.

2. Description of the Related Art

Liquid droplet-jetting apparatuses are known, which jet liquid droplets from nozzles by applying the pressure to the liquid contained in pressure chambers communicated with the plurality of nozzles by means of the piezoelectric actuator. Some of the liquid droplet-jetting apparatuses as described above adjust the jetting characteristic of the liquid droplets to be jetted from the nozzles by changing, for each of the nozzles, the structure of the channel communicated with the nozzle. For example, in the case of an ink-jetting apparatus described in Japanese Patent Application Laid-open No. 8-281948 (FIG. 5), the structure of the channel communicated with the nozzle is changed by changing the position of the manifold channel communicated with the corresponding ink chamber for each of the nozzles.

For example, the following situation sometimes arises in relation to an ink-jet head (liquid droplet-jetting apparatus) which has nozzles for jetting black ink droplets and nozzles for jetting color ink droplets. That is, it is required that the jetting characteristic of the liquid droplets should be changed for each of the nozzles provided for the different types of liquid droplets to be jetted. For example, when the monochrome printing (black and white printing) is performed, the printing is performed at a high speed by jetting large volumes of black ink droplets, while when the color printing is performed, the high image quality printing is performed by jetting small volumes of color ink droplets. In such a situation, the jetting characteristic of liquid droplets can be also changed for each of the nozzles provided for the different types of liquid droplets to be jetted, by changing the structure of the channel. For example, as shown in FIG. 22, it is possible to make a volume of a black ink droplet greater than that of a color ink droplet by making the size of a pressure chamber for black ink 500*a* greater than that of a pressure chamber for color ink 500*b*. However, the channels, which are communicated with the nozzles, have the structures which are different between the respective nozzles having the different jetting characteristics. Therefore, the structures of the channels are consequently complicated. On the other hand, other than the change of the structure of the channel, it is also conceived that the voltage, which is applied to drive the corresponding piezoelectric actuator, is changed for each of the nozzles having the different jetting characteristics. However, in this case, the circuit for applying the voltage has the complicated configuration, for example, such that a plurality of power sources are required.

SUMMARY OF THE INVENTION

An object of the present invention is to provide a liquid droplet-jetting apparatus which makes it possible to change the jetting characteristic of liquid droplets for each of nozzles without complicating the structure, and a method for producing the liquid droplet-jetting apparatus.

According to a first aspect of the present invention, there is provided a liquid droplet-jetting apparatus which jets liquid droplets of a liquid including; a channel unit which is formed with a first channel including a first nozzle and a first pressure chamber communicated with the first nozzle and a second channel including a second nozzle and a second pressure chamber communicated with the second nozzle, the second channel having a same channel structure as that of the first channel; and a piezoelectric actuator which includes a vibration plate arranged on one surface of the channel unit while covering the first and second pressure chambers, a piezoelectric layer arranged to face the first and second pressure chambers on a surface of the vibration plate disposed on a side not facing the channel unit, and a pair of electrodes applying a voltage to the piezoelectric layer, and in which the vibration plate, the piezoelectric layer, and the electrodes are stacked, wherein a portion of one of the vibration plate, the piezoelectric layer, and the electrodes facing the first pressure chamber is thinner than a portion of the one of the vibration plate, the piezoelectric layer, and the electrodes facing the second pressure chamber. The present invention may have such a form that the vibration plate also serves as one of the pair of electrodes for applying the voltage to the piezoelectric layer when the vibration plate is conductive. The present invention also includes the form as described above.

Accordingly, the rigidity of the portion of the piezoelectric actuator facing the first pressure chamber is smaller than the rigidity of the portion facing the second pressure chamber. Therefore, even when the first channel has the same channel structure as that of the second channel, when the same voltage is applied to the portion of the piezoelectric layer facing the first pressure chamber and the portion facing the second pressure chamber, then the portion of the vibration plate facing the first pressure chamber is deformed more greatly than the portion facing the second pressure chamber, and the volume of the first pressure chamber is changed more greatly than the volume of the second pressure chamber. Accordingly, the pressure, which is larger than that to be applied to the liquid contained in the second pressure chamber, can be applied to the liquid contained in the first pressure chamber. The liquid droplets, which have the larger volumes than those of the liquid droplets to be jetted from the second nozzle, can be jetted from the first nozzle.

In the liquid droplet-jetting apparatus of the present invention, size of the liquid droplets jetted from the first nozzle may be larger than size of the liquid droplets jetted from the second nozzle, the piezoelectric layer may be contracted in a plane direction of the vibration plate to deform the vibration plate so that the vibration plate projects toward each of the first and second pressure chambers when the voltage is applied to the electrodes; and a pressure may be applied to the liquid in each of the first and second pressure chambers to jet the liquid droplets.

When the pull type jetting operation (pulling ejection), in which the liquid droplets are jetted from the nozzle such that the pressure in the pressure chamber is once decreased by the piezoelectric actuator and the pressure in the pressure chamber is increased at the timing at which the negative pressure wave thus generated in the pressure chamber is inverted into the positive and returned, is performed, the transmission velocity of the pressure wave in the first channel is slower than the transmission velocity of the pressure wave in the second channel. Therefore, the volume of the liquid droplets jetted from the first nozzle is further increased as compared with the volume of the liquid droplets jetted from the second nozzle.

Further, the first channel and the second channel have the same channel structure in the channel unit. Therefore, it is possible to construct the liquid droplet-jetting apparatus in which the positions of the nozzles having different jetting characteristics and the ratio of the numbers thereof differ, by using the identical channel unit.

In the liquid droplet-jetting apparatus of the present invention, the first channel and the second channel may include a plurality of first individual channels and a plurality of second individual channels respectively; a plurality of the first pressure chambers may form a first pressure chamber array arranged in a predetermined direction, and a plurality of the second pressure chambers may form a second pressure chamber array arranged in the predetermined direction; and a portion of one of the vibration plate, the piezoelectric layer, and the electrodes facing the first pressure chamber array may be thinner than another portion of one of the vibration plate, the piezoelectric layer, and the electrodes facing the second pressure chamber array.

In this arrangement, the first and second pressure chamber arrays include the plurality of first and second individual channels arranged in the predetermined direction respectively. Therefore, the area facing the first pressure chamber array and the area facing the second pressure chamber array, which are provided on the surface of the vibration plate disposed on the side opposite to the channel unit, have relatively large areal sizes respectively. Therefore, it is possible to easily form the piezoelectric actuator which have the mutually different thicknesses at the portion facing the first pressure chamber and the portion facing the second pressure chamber.

In the liquid droplet-jetting apparatus of the present invention, the liquid may include a black ink and a color ink; and droplets of the black ink may be jetted from the first nozzle, and droplets of the color ink may be jetted from the second nozzle. In this arrangement, the monochrome printing (black and white printing) can be performed at a high speed by jetting the black ink droplets having the large volume from the first nozzle to the recording medium. Further, the color printing can be performed at a high image quality by jetting the color ink droplets having the small volume from the second nozzle to the recording medium.

In the liquid droplet-jetting apparatus of the present invention, the liquid may include a pigment ink and a dye ink; and droplets of the pigment ink may be jetted from the first nozzle, and droplets of the dye ink may be jetted from the second nozzle. In this arrangement, the pigment ink, which hardly causes the blur, is jetted in the large volume from the first nozzle to the recording medium, and the dye ink, which tends to cause the blur, is jetted in the small volume from the second nozzle to the recording medium. Accordingly, the high image quality printing, in which the blur is scarcely caused, can be performed.

In the liquid droplet-jetting apparatus of the present invention, the portion of the piezoelectric layer facing the first pressure chamber may be thinner than the another portion facing the second pressure chamber. In this arrangement, it is possible to easily form the piezoelectric actuator in which the rigidity differs between the portion of the piezoelectric layer facing the first pressure chamber and the portion facing the second pressure chamber, by changing the thickness of the piezoelectric layer. The big globular liquid droplets can be discharged from the first nozzle.

Further, the portion of the piezoelectric layer facing the first pressure chamber is thinner than the portion facing the second pressure chamber. Therefore, when the same voltage is applied to these portions of the piezoelectric layer, the electric field intensity, which is obtained at the portion facing the first pressure chamber, is larger than the electric field intensity which is obtained at the portion facing the second pressure chamber. Accordingly, the amount of contraction (shrinkage) of the portion of the piezoelectric layer facing the first pressure chamber in the surface direction is larger than the amount of shrinkage of the portion facing the second pressure chamber in the surface direction. The portion of the vibration plate facing the first pressure chamber is deformed more greatly as compared with the portion facing the second pressure chamber. Therefore, the volume of the liquid droplet jetted from the first nozzle is much larger than the volume of the liquid droplet jetted from the second nozzle.

In the liquid droplet-jetting apparatus of the present invention, the portion of the vibration plate facing the first pressure chamber may be thinner than the another portion facing the second pressure chamber. In this arrangement, it is possible to easily form the piezoelectric actuator in which the thickness differs between the portion facing the first pressure chamber and the portion facing the second pressure chamber, by changing the thickness of the vibration plate. The big globular liquid droplets can be discharged from the first nozzle.

In the liquid droplet-jetting apparatus of the present invention, the vibration plate may be made of metal; the piezoelectric actuator may include an insulating layer which is arranged on the surface of the vibration plate disposed on the side not facing the channel unit and which insulates the vibration plate from the electrodes; and a portion of the insulating layer facing the first pressure chamber may be thinner than another portion of the insulating layer facing the second pressure chamber. In this arrangement, when the piezoelectric actuator has the insulating layer to insulate the vibration plate made of metal from the electrode, it is possible to easily form the piezoelectric actuator in which the thickness differs between the portion facing the first pressure chamber and the portion facing the second pressure chamber, by changing the thickness of the insulating layer. The big globular liquid droplets can be discharged from the first nozzle.

According to a second aspect of the present invention, there is provided a method for producing a liquid droplet-jetting apparatus; the liquid droplet-jetting apparatus including a channel unit which is formed with a first channel including a first nozzle and a first pressure chamber communicated with the first nozzle and a second channel including a second nozzle and a second pressure chamber communicated with the second nozzle, the second channel having a same channel structure as that of the first channel; and a piezoelectric actuator which includes a vibration plate arranged on a surface of the channel unit while covering the first and second pressure chambers, a piezoelectric layer arranged to face the first and second pressure chambers on a surface of the vibration plate disposed on a side not facing the channel unit, and a pair of electrodes applying a voltage to the piezoelectric layer, and in which the vibration plate, the piezoelectric layer, and the electrodes are stacked, the method including:

forming the channel unit so that the first channel has a same channel structure as that of the second channel;

forming the piezoelectric actuator by stacking the vibration plate, the piezoelectric layer, and the electrodes;

joining the vibration plate to the surface of the channel unit, wherein:

a portion of one of the vibration plate, the piezoelectric layer, and the electrodes facing the first pressure chamber is formed to be thinner than another portion of the one of the vibration plate, the piezoelectric layer, and the electrodes facing the second pressure chamber when the piezoelectric actuator is formed.

According to the second aspect of the present invention, the portion of one of the vibration plate, the piezoelectric layer, and the electrode facing the first pressure chamber is formed to be thinner than the portion facing the second pressure chamber, when the piezoelectric actuator is formed. Accordingly, the rigidity of the portion of the piezoelectric actuator facing the first pressure chamber can be made smaller than the rigidity of the portion facing the second pressure chamber. Therefore, when the channel unit is formed, the channel unit can be formed so that the same channel structure is provided for the first channel and the second channel. In this arrangement, when the same voltage is applied to the portion of the piezoelectric layer facing the first pressure chamber and the portion facing the second pressure chamber, then the portion of the vibration plate facing the first pressure chamber is deformed more greatly as compared with the portion facing the second pressure chamber, and the volume of the first pressure chamber is changed more greatly as compared with the volume of the second pressure chamber. Accordingly, it is possible to apply the larger pressure to the liquid in the first pressure chamber as compared with the liquid in the second pressure chamber, and it is possible to jet the liquid droplets having the larger volume from the first nozzle as compared with the second nozzle.

Further, when the channel unit is formed, the channel unit is formed so that the first channel and the second channel have the identical channel structure. Therefore, it is possible to produce the liquid droplet-jetting apparatus which differs, for example, in the positions of the first nozzle and the second nozzle and the ratio between the numbers of the first nozzle and the second nozzle by using the identical channel unit. The plurality of layers of the present invention include the vibration plate, the piezoelectric layer, and the pair of electrodes.

In the method for producing the liquid droplet-jetting apparatus of the present invention, in the liquid droplet-jetting apparatus, liquid droplets of a liquid jetted from the first nozzle may be larger than liquid droplets jetted from the second nozzle; the piezoelectric layer may be contracted in a plane direction of the vibration plate to deform the vibration plate so that the vibration plate projects toward each of the first and second pressure chambers when the voltage is applied to the electrodes; and a pressure may be applied to the liquid in each of the first and second pressure chambers to jet the liquid droplets.

When the pull type jetting operation, in which the liquid droplets are jetted from the nozzle such that the pressure in the pressure chamber is once decreased by the piezoelectric actuator and the pressure in the pressure chamber is increased at the timing at which the negative pressure wave having been generated upon the pressure decrease in the pressure chamber is inverted into the positive and returned, is performed, the transmission velocity of the pressure wave in the first channel is slower than the transmission velocity of the pressure wave in the second channel. Therefore, the volume of the liquid droplets jetted from the first nozzle is further increased as compared with the volume of the liquid droplets jetted from the second nozzle.

In the method for producing the liquid droplet-jetting apparatus of the present invention, one layer of the vibration plate, the piezoelectric layer, and the electrodes of the piezoelectric actuator may be formed by a particle deposition method in which particles for constructing the one layer are deposited on a predetermined substrate when the piezoelectric actuator is formed. In this procedure, when the particle deposition method is used, the thickness of the layer can be formed freely. Therefore, it is possible to easily form the layer which differs in the thickness between the portion facing the first pressure chamber and the portion facing the second pressure chamber.

In the method for producing the liquid droplet-jetting apparatus of the present invention, the particle deposition method may be an aerosol deposition method or a sputtering method. In this procedure, when the aerosol deposition method or the sputtering method is used as the particle deposition method, the portion of one layer of the vibration plate, the piezoelectric layer, and the electrodes of the piezoelectric actuator facing the first pressure chamber and the portion facing the second pressure chamber can be easily formed so that they have the mutually different thicknesses.

In the method for producing the liquid droplet-jetting apparatus of the present invention, the formation of the piezoelectric actuator may include formation of a recess on a surface of the vibration plate; and the vibration plate may be joined to the surface of the channel unit so that the recess faces to the first pressure chamber when the vibration plate is joined to the channel unit. In this procedure, the vibration plate, in which the thickness differs between the portion facing the first pressure chamber and the portion facing the second pressure chamber, can be formed with ease by forming the recess for the vibration plate, for example, by means of the half etching.

According to a third aspect of the present invention, there is provided a liquid droplet-jetting apparatus which jets liquid droplets of a liquid including; a channel unit which is formed with a first channel including a first nozzle and a first pressure chamber communicated with the first nozzle, and a second channel including a second nozzle and a second pressure chamber communicated with the second nozzle, the second channel having a same channel structure as that of the first channel; and a piezoelectric actuator which includes a vibration plate arranged on one surface of the channel unit while covering the first and second pressure chambers, a piezoelectric layer arranged, to face the first and second pressure chambers, on a surface of the vibration plate disposed on a side not facing the channel unit, and a pair of electrodes applying a voltage to the piezoelectric layer, and in which the vibration plate, the piezoelectric layer, and the electrodes are stacked;

wherein rigidity of a portion of the piezoelectric actuator facing the first pressure chamber is smaller than rigidity of another portion of the piezoelectric actuator facing the second pressure chamber.

According to the third aspect of the present invention, the rigidity of the portion of the piezoelectric actuator facing the first pressure chamber is smaller than the rigidity of the portion facing the second pressure chamber. Therefore, even when the first channel and the second channel are constructed to have the identical channel structure, the transmission velocity of the pressure wave in the first channel can be made slower than that in the second channel. Therefore, the volume of the liquid droplet jetted from the first nozzle can be made larger than the volume of the liquid droplet jetted from the second nozzle. Further, the rigidity of the portion of the piezoelectric actuator facing the first pressure chamber is smaller than the rigidity of the portion facing the second pressure chamber. Therefore, the deformation of the portion of the piezoelectric actuator facing the first pressure chamber can be made larger than the deformation of the portion facing the second pressure chamber. As a result, the volume of the liquid droplet jetted from the first nozzle can be made larger than the volume of the liquid droplet jetted from the second nozzle.

In the liquid droplet-jetting apparatus of the present invention, the first and second pressure chambers may have substantially elliptical shapes which are long in a predetermined longitudinal direction; and a recess may be formed at a portion, of one of the vibration plate and the piezoelectric layer, facing a substantially central portion of the first pressure chamber. In this arrangement, the recess is formed at the portion facing the substantially central portion of the first pressure chamber. Therefore, it is possible to lower the rigidity of the portion of the piezoelectric actuator facing the first pressure chamber. The volume of the liquid droplet jetted from the first nozzle can be made larger than the volume of the liquid droplet jetted from the second nozzle.

In the liquid droplet-jetting apparatus of the present invention, a hollow space may be formed in an area between the vibration plate and the piezoelectric layer, the area overlapping with the substantially central portion of the first pressure chamber. Further, the hollow space may be filled with a low rigidity material which has rigidity lower than those of the vibration plate and the piezoelectric layer. In any one of the arrangements described above, the recess is formed at the portion facing the substantially central portion of the first pressure chamber. Therefore, it is possible to lower the rigidity of the portion of the piezoelectric actuator facing the first pressure chamber. The volume of the liquid droplet jetted from the first nozzle can be made larger than the volume of the liquid droplet jetted from the second nozzle.

In the liquid droplet-jetting apparatus of the present invention, the pair of electrodes may include a ring-shaped electrode formed in an area, of the piezoelectric layer, overlapped with a peripheral portion (an outer edge portion) of each of the first and second pressure chambers. In this arrangement, the ring-shaped individual electrode is formed. Therefore, when the voltage is applied to the individual electrode, the vibration plate can be deformed so that the central portion of the pressure chamber is expanded to be convex. Therefore, even when the pull type jetting operation is performed, then it is unnecessary to always apply the voltage to the electrodes, it is possible to avoid the deterioration of the piezoelectric layer, and it is possible to reduce the electric power consumption.

In the liquid droplet-jetting apparatus of the present invention, the first and second pressure chambers may have substantially elliptical shapes which are long in a predetermined longitudinal direction; and a groove may be formed at a portion of one of the vibration plate and the piezoelectric layer facing a peripheral portion of the first pressure chamber. The groove may be filled with a low rigidity material which has rigidity lower than those of the vibration plate and the piezoelectric layer. The groove may be formed on only one end side of one of the vibration plate and the piezoelectric layer in the length direction of the first pressure chamber. Further, the groove may include a first groove which is formed at an end of one of the vibration plate and the piezoelectric layer in the length direction of the first pressure chamber, and a second groove which is formed in the length direction of the pressure chamber, and the first groove may be deeper than the second groove. Still further, a groove surrounding the first pressure chamber may be formed on an area, of the vibration plate, outside an overlapping area at which the vibration plate overlaps with the pair of the electrodes. In any one of the arrangements described above, it is possible to lower the rigidity of the portion of the piezoelectric actuator facing the first pressure chamber. The volume of the liquid droplet jetted from the first nozzle can be made larger than the volume of the liquid droplet jetted from the second nozzle.

In the liquid droplet-jetting apparatus of the present invention, a portion, of the piezoelectric layer, facing the first pressure chamber may be formed of a first piezoelectric material, another portion, of the piezoelectric layer, facing the second pressure chamber may be formed of a second piezoelectric material which is different from the first piezoelectric material, and rigidity of the portion of the piezoelectric layer facing the first pressure chamber may be lower than that of the another portion facing the second pressure chamber. The volume of the liquid droplet jetted from the first nozzle can be made larger than the volume of the liquid droplet jetted from the second nozzle.

DESCRIPTION OF THE PREFERRED EMBODIMENTS

Preferred embodiments of the present invention will be explained below.

Figure 1:
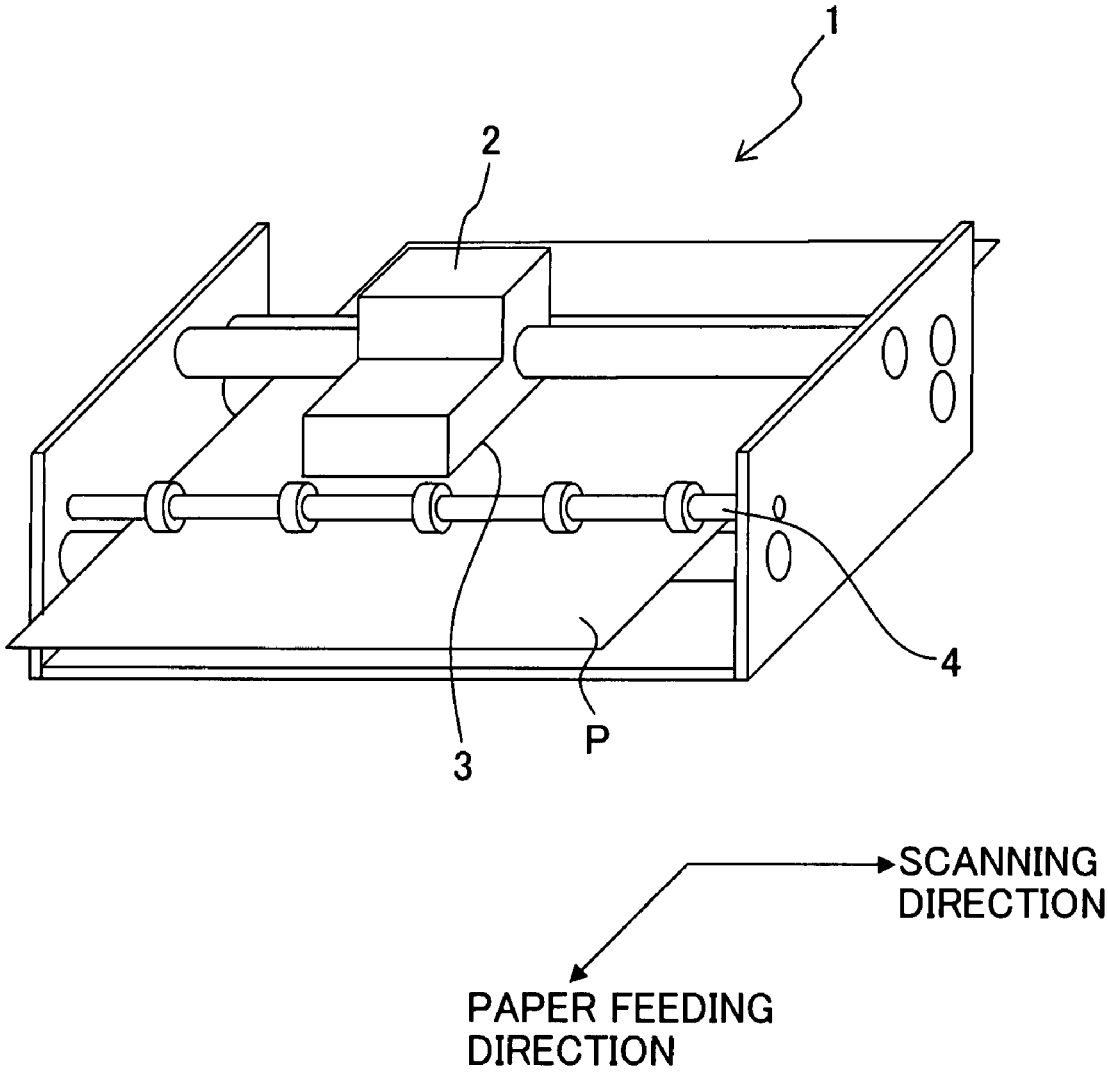
FIG. 1 shows a schematic arrangement illustrating a printer according to an embodiment of the present invention.

FIG. 1 schematically shows a printer according to an embodiment of the present invention. As shown in FIG. 1, the printer 1 includes a carriage 2, an ink-jet head 3 (liquid droplet-jetting apparatus), and a printing paper transport roller 4. The carriage 2 makes the reciprocating movement in the left-right direction (scanning direction) as shown in FIG. 1. The ink-jet head 3 is provided on the lower surface of the carriage 2. The ink-jet head 3 makes the reciprocating motion in the scanning direction together with the carriage 2, while the ink droplets are jetted from nozzles 15*a*, 15*b* (see FIG. 2) formed on the lower surface of the ink-jet head 3. The printing paper transport roller 4 transports the recording paper P in the direction directed toward the front of FIG. 1 (in the paper feeding direction). In the printer 1, the ink droplets are jetted onto the recording paper P which is transported by the printing paper transport roller 4 in the paper feeding direction by means of the ink-jet head 3 which makes the reciprocating movement in the scanning direction together with the carriage 2. The recording paper P, on which the printing is completed, is discharged by the printing paper transport roller 4.

Next, the ink-jet head 3 shown in FIG. 1 will be explained with reference to FIGS. 2 to 6.

As shown in FIGS. 2 to 6, the ink-jet head 3 has a channel unit 30 which is formed with ink channels including manifold channels 11*a*, 11*b* and pressure chambers 10*a*, 10*b* as described later on, and a piezoelectric actuator 31 which is arranged on the upper surface of the channel unit 30.

As shown in FIGS. 2 to 6, the channel unit 30 includes a cavity plate 21, a base plate 22, a manifold plate 23, and a nozzle plate 24, and the four plates are mutually stacked. Three of the plates 21 to 23 except for the nozzle plate 24 are composed of a metal material such as stainless steel. The nozzle plate 24 is composed of a synthetic resin material such as polyimide. Alternatively, the nozzle plate 24 may be also made of metal in the same manner as the other three plates 21 to 23.

Figure 2:
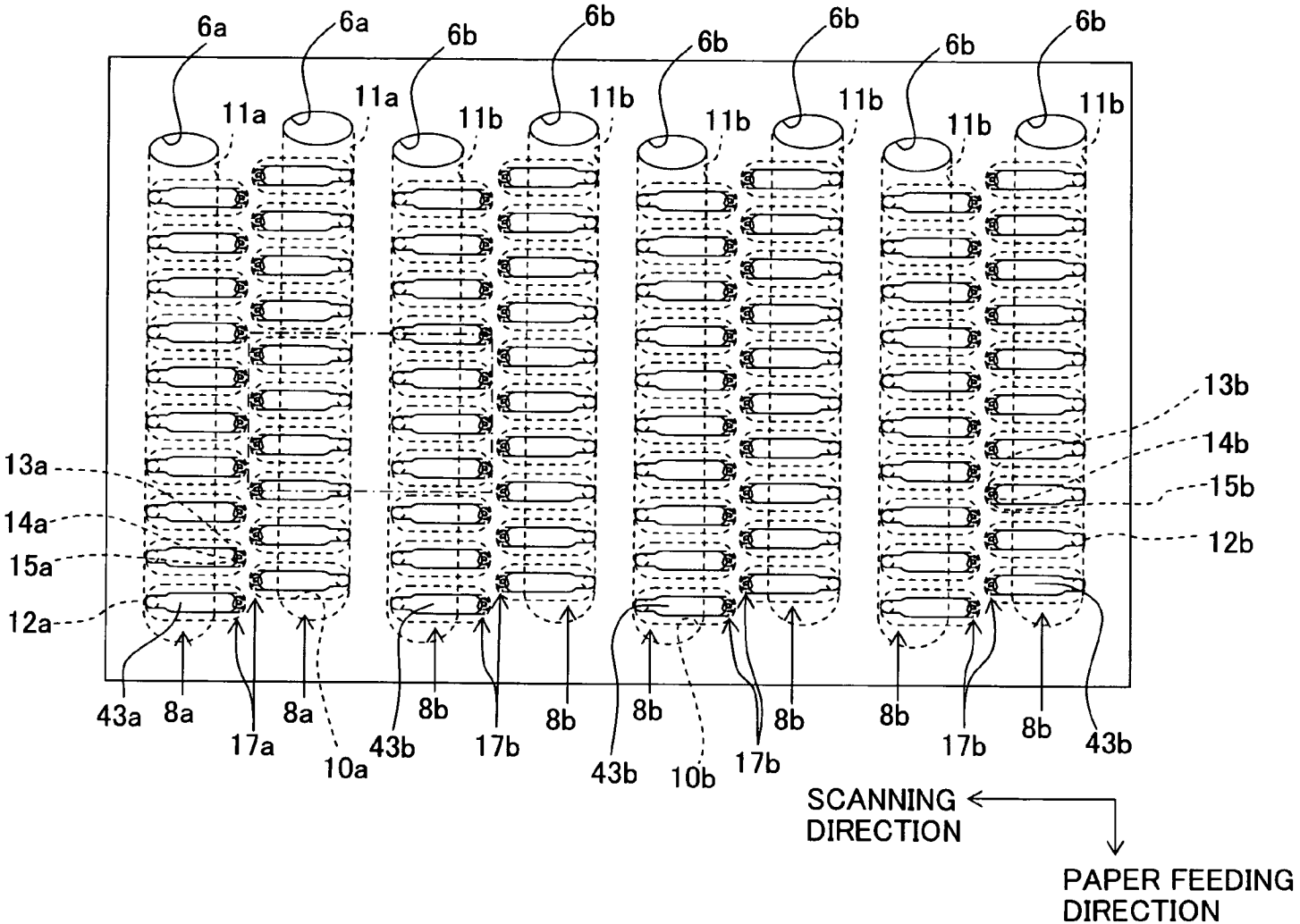
FIG. 2 shows a plan view illustrating an ink-jet head shown in FIG. 1.
Figure 3:
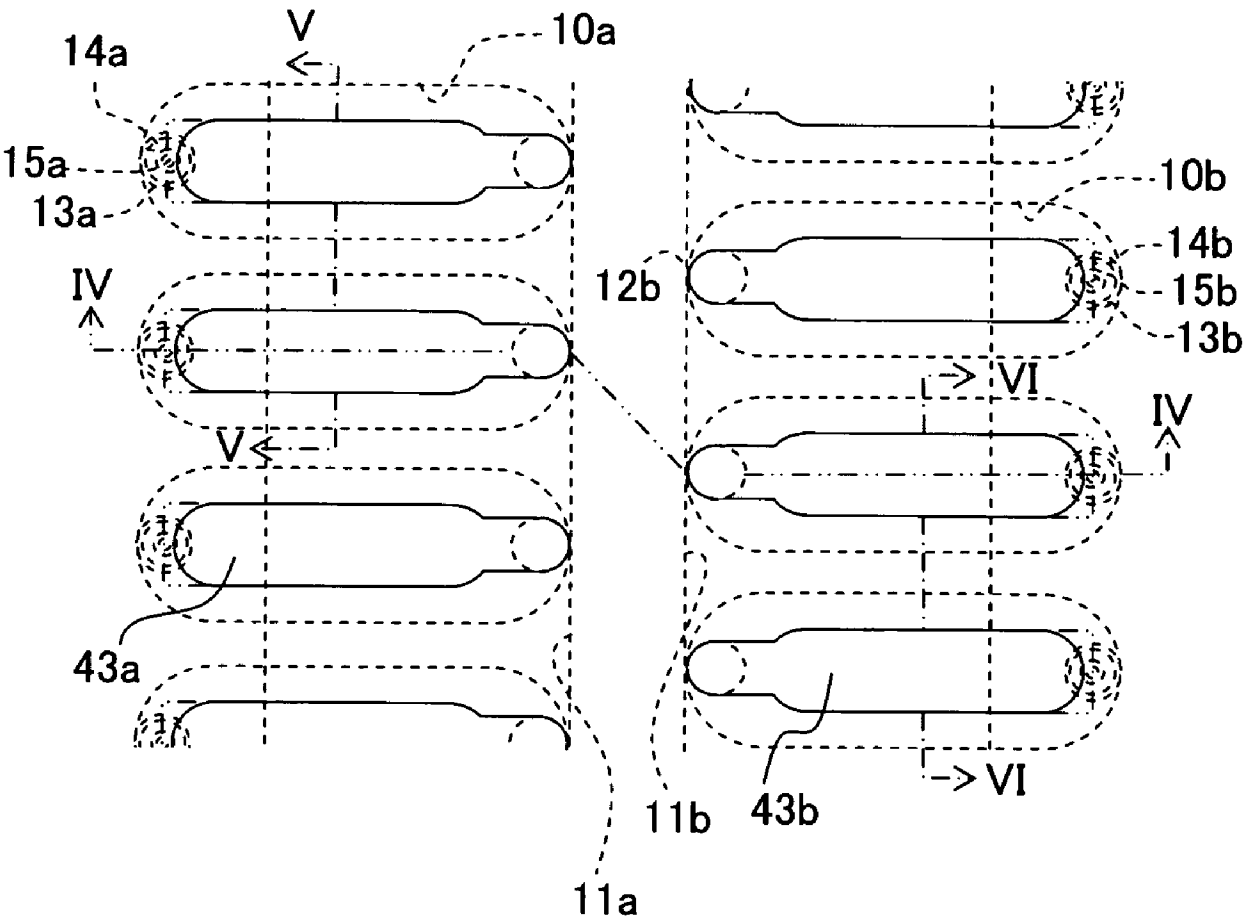
FIG. 3 shows a magnified view illustrating a portion surrounded by dashed lines shown in FIG. 2.

Two pressure chamber arrays 8*a* (first pressure chamber arrays) and six pressure chamber arrays 8*b* (second pressure chamber arrays) are arranged and aligned respectively in the left-right direction as shown in FIG. 2 on the cavity plate 21. The pressure chamber arrays 8*b* are arranged on the right side of the pressure chamber arrays 8*a*. Each of the pressure chamber arrays 8*a* includes ten pressure chambers 10*a* arranged in the upward-downward direction as shown in FIG. 2. Each of the pressure chamber arrays 8*b* also includes ten pressure chambers 10*b* arranged in the same manner as described above. The plurality of pressure chambers 10*a*, 10*b* are open at the upper surface of the cavity plate 21. Each of the pressure chambers 10*a* (first pressure chambers) and the pressure chambers 10*b* (second pressure chambers) is substantially elliptical as viewed in a plan view. The longitudinal direction thereof is coincident with the left-right direction as shown in FIG. 2. Through-holes 12*a* and through-holes 13*a* are formed at portions of the base plate 22 facing the both ends of the plurality of pressure chambers 10*a* in the longitudinal direction respectively. Through-holes 12*b* and through-holes 13*b* are formed at portions facing the both ends of the plurality of pressure chambers 10*b* in the longitudinal direction respectively. The through-holes 12*a* and the through-holes 12*b* have identical shapes, and the through-holes 13*a* and the through-holes 13*b* have identical shapes.

Two manifold channels 11*a*, which extend in the upward-downward direction as shown in FIG. 2, are formed through the manifold plate 23. The respective manifold channels 11*a* are overlapped with the plurality of pressure chambers 10*a* included in the respective pressure chamber arrays 8*a* respectively. In other words, each of the manifold channels 11*a* is overlapped with the portion except for the end on the side on which the through-holes 13*a* are formed, in the longitudinal direction of the plurality of pressure chambers 10*a* for constructing each of the pressure chamber arrays 8*a* as viewed in a plan view. Each of the manifold channels 11*a* is communicated with the plurality of pressure chambers 10*a* for constructing each of the pressure chamber arrays 8*a* via the plurality of through-holes 12*a*. The black ink is supplied to the manifold channel 11*a* from an ink supply port 6*a* formed in the vicinity of the upper end of the vibration plate 40 as shown in FIG. 2 as described later on.

Six manifold channels 11*b*, which extend in the upward-downward direction as shown in FIG. 2, are formed through the manifold plate 23. The respective manifold channels 11*b* are overlapped with the plurality of pressure chambers 10*b* included in the respective pressure chamber arrays 8*b* respectively. The manifold channel 11*b* has the same shape as that of the manifold channel 11*a*. The manifold channel 11*b* is overlapped with the portion except for the end on the side on which the through-holes 13*b* are formed, in the longitudinal direction of the plurality of pressure chambers 10*b* included in each of the pressure chamber arrays 8*b* as viewed in a plan view. The manifold channel 11*b* is communicated with the plurality of through-holes 12*b* communicated with the plurality of pressure chambers 10*b* included in the corresponding pressure chamber array 8*b*. The cyan, yellow, and magenta inks (color inks) are supplied to the manifold channels 11*b* which are arranged in this order as starting from those disposed on the left side as shown in FIG. 2. The inks are supplied from ink supply ports 6*b* formed in the vicinity of the upper end of the vibration plate 40 as shown in FIG. 2 as described later on.

A plurality of through-holes 14*a*, 14*b* are formed at portions of the manifold plate 23 facing the plurality of through-holes 13*a*, 13*b* respectively. The manifold channel 11*a*, the ink supply port 6*a*, and the through-hole 14*a* have the same shapes as those of the manifold channel 11*b*, the ink supply port 6*b*, and the through-hole 14*b* respectively.

Two nozzle arrays 17*a*, which are arranged and aligned in the left-right direction as shown in FIG. 2 corresponding to the two pressure chamber arrays 8*a*, are formed for the nozzle plate 24. Each of the nozzle arrays 17*a* includes ten nozzles 15*a* (first nozzles) arranged in the upward-downward direction as shown in FIG. 2. The plurality of nozzles 15*a* are formed respectively at positions of the nozzle plate 14 facing the plurality of through-holes 14*a*. Six nozzle arrays 17*b*, which are arranged and aligned in the left-right direction as shown in FIG. 2 corresponding to the six pressure chamber arrays 8*b*, are formed for the nozzle plate 24. Each of the nozzle arrays 17*b* includes ten nozzles 15*b* (second nozzles) arranged in the upward-downward direction as shown in FIG. 2. The nozzles 15*b* have the same shapes as those of the nozzles 15*a*, which are formed at portions of the nozzle plate 24 facing the plurality of through-holes 14*b*.

The manifold channel 11*a* is communicated with the pressure chambers 10*a* via the through-holes 12*a*. The pressure chambers 10*a* are further communicated with the nozzles 15*a* via the through-holes 13*a*, 14*a*. The manifold channel 11*b* is communicated with the pressure chambers 10*b* via the through-holes 12*b*. The pressure chambers 10*b* are further communicated with the nozzles 15*b* via the through-holes 13*b*, 14*b*. In this way, a plurality of individual ink channels 32*a* and a plurality of individual ink channels 32*b* are formed in the channel unit 30, the plurality of individual ink channels 32*a* ranging from the outlets of the manifold channels 11*a* via the pressure chambers 10*a* to arrive at the nozzles 15*a*, and the plurality of individual ink channels 32*b* ranging from the outlets of the manifold channels 11*b* via the pressure chambers 10*b* to arrive at the nozzles 15*b*.

Accordingly, the black ink, which is supplied from the ink supply port 6*a* to the manifold channel 11*a*, is allowed to flow to arrive at the nozzles 15*a* along with the individual ink channels 32*a*. The black ink droplets are jetted from the nozzles 15*a* as described later on. On the other hand, the color inks, which are supplied from the ink supply ports 6*b* to the manifold channels 11*b*, are allowed to flow to arrive at the nozzles 15*b* along with the individual ink channels 32*b*. The cyan, yellow, and magenta ink droplets are jetted from the nozzles 15*b* included in the first and second nozzle arrays 17*b*, the nozzles 15*b* included in the third and fourth nozzle arrays 17*b*, and the nozzles 15*b* included in the fifth and sixth arrays 17*b* as referred to as starting from the left side as shown in FIG. 2 respectively.

The ink channel, which is composed of one manifold channel 11*a* and the plurality of individual ink channels 32*a* communicated with the manifold channel 11*a*, corresponds to the first channel according to the present invention. The ink channel, which is composed of one manifold channel 11*b* and the plurality of individual ink channels 32*b* communicated with the manifold channel 11*b*, corresponds to the second channel according to the present invention. As described above, the pressure chamber 10*a*, the through-hole 12*a*, the through-hole 13*a*, the through-hole 14*a*, the nozzle 15*a*, and the manifold channel 11*a* have the same shapes as those of the pressure chamber 10*b*, the through-hole 12*b*, the through-hole 13*b*, the through-hole 14*b*, the nozzle 15*b*, and the manifold channel 11*b* respectively. Therefore, the first channel has the same channel structure as that of the second channel.

Next, the piezoelectric actuator 31 will be explained. As shown in FIGS. 2 to 5, the piezoelectric actuator 31 is a unimorph type piezoelectric actuator which has a vibration plate 40, an insulating layer 41, a piezoelectric layer 42, individual electrodes 43*a*, 34*b*, and a common electrode 44 and which is constructed by stacking the plurality of layers.

The vibration plate 40 is a plate-shaped member which is made of metal, which is substantially rectangular, and which has a thickness of about 20 μm. The vibration plate 40 is joined to the upper surface of the cavity plate 21 while covering the upper surface of the channel unit 30 therewith. In other words, the vibration plate 40 defines the upper surfaces of the pressure chambers 10*a*, 10*b*. The insulating layer 41 is formed of, for example, an insulative ceramic material such as alumina or zirconia, or a synthetic resin material such as polyimide. The insulating layer 41 is provided on the entire region of the upper surface of the vibration plate 40. The insulating layer 41 has a thickness of about 2 μm.

Figure 4:
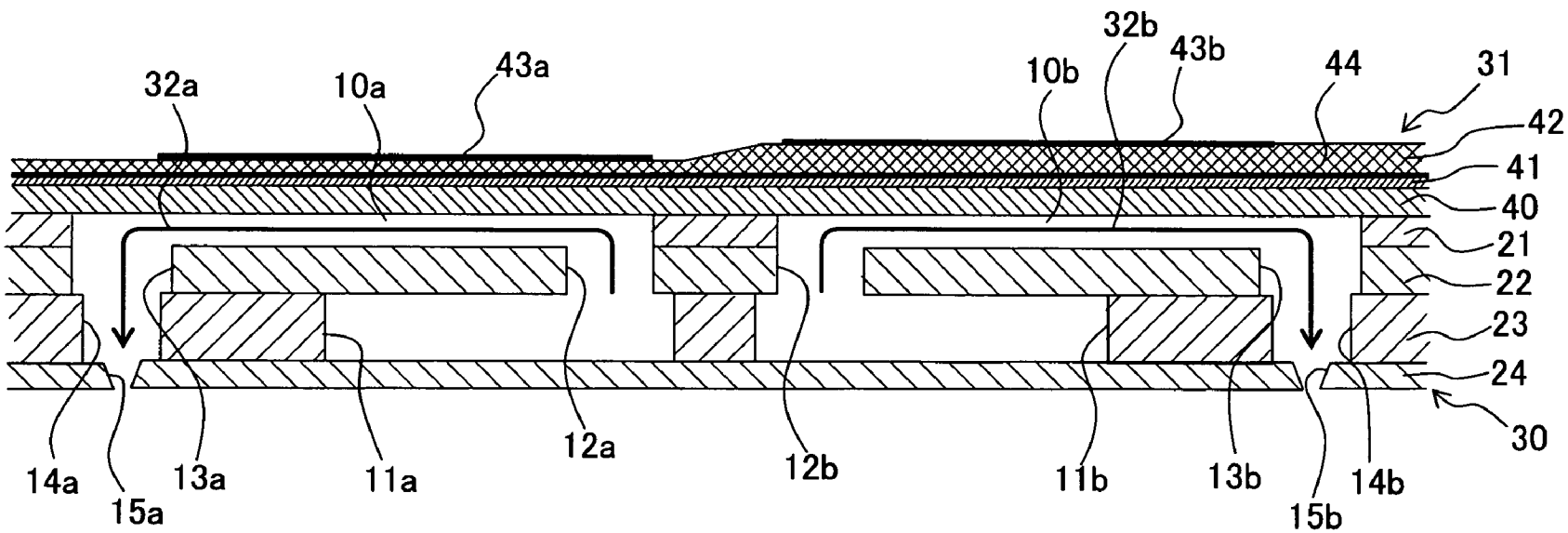
FIG. 4 shows a sectional view taken along a line IV-IV shown in FIG. 3.
Figure 5:
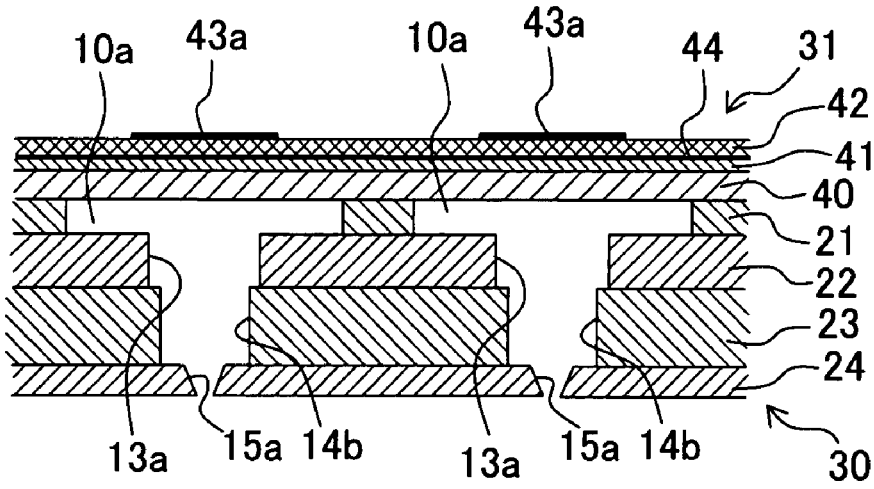
FIG. 5 shows a sectional view taken along a line V-V shown in FIG. 3.
Figure 6:
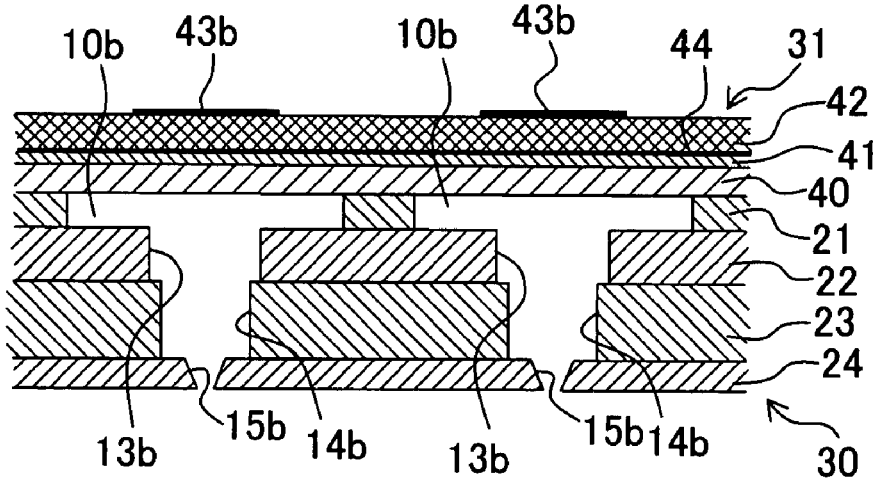
FIG. 6 shows a sectional view taken along a line VI-VI shown in FIG. 3.

The piezoelectric layer 42 is provided continuously to range over the plurality of pressure chambers 10*a*, 10*b* on the upper surface of the insulating layer 41. In other words, the piezoelectric layer 42 is arranged while being facing the pressure chambers 10*a*, 10*b* on the side opposite to (not facing) the vibration plate 40 and the channel unit 30 in relation to the insulating layer 41. As shown in FIGS. 4 to 6, the piezoelectric layer 42 has a thickness of about 7.5 μm at the portion facing the two pressure chamber arrays 8*a* and the vicinity thereof. The piezoelectric layer 42 has a thickness of about 15 μm at the portion facing the six pressure chamber arrays 8*b* and the vicinity thereof. In other words, the portion of the piezoelectric layer 42, which is facing the pressure chamber arrays 8*a*, is thinner than the portion which is facing the pressure chamber arrays 8*b*. The piezoelectric layer 42 is previously polarized in the thickness direction thereof.

The individual electrode 43*a* is formed of a conductive material. The individual electrode 43*a* has a substantially elliptical shape that is one size smaller than that of the pressure chamber 10*a*. The individual electrode 43*a* has a thickness of about 1 μm. The individual electrode 43*a* is formed at the portion of the upper surface of the piezoelectric layer 42 facing the substantially central portion of the pressure chamber 10*a*. The individual electrode 43*b* is formed of a conductive material in the same manner as the individual electrode 43*a*. The individual electrode 43*b* has a substantially elliptical shape in the same manner as the individual electrode 43*a*. The individual electrode 43*b* has a thickness of about 1 μm as well. The thickness of the individual electrode 43*b* is approximately the same as the thickness of the individual electrode 43*a*. The individual electrode 43*b* is formed at the portion of the upper surface of the piezoelectric layer 42 facing the substantially central portion of the pressure chamber 10*b*. The ends of the individual electrodes 43*a*, 43*b*, which are disposed on the sides opposite to the nozzles 15*a*, 15*b* in the longitudinal direction, extend to the positions facing the ends of the pressure chambers 10*a*, 10*b* disposed on the sides opposite to the nozzles 15*a*, 15*b* in the longitudinal direction respectively. The forward ends thereof are formed with contacts to be electrically connected to an unillustrated flexible printed circuit board (FPC) respectively. The driving electric potential is applied to the individual electrodes 43*a*, 43*b* by an unillustrated driver IC via FPC and the contacts.

The common electrode 44 is formed of a conductive material in the same manner as the individual electrodes 43*a*, 43*b*. The common electrode 44 has a thickness of about 1 μm. The common electrode 44 is formed between the insulating layer 41 and the piezoelectric layer 42. The common electrode 44 is always retained at the ground electric potential. Accordingly, the portions of the piezoelectric layer 42 facing the pressure chambers 10 are interposed between individual electrodes 43*a* and the common electrode 44, and the portions of the piezoelectric layer 42 facing the pressure chambers 10*b* are interposed between the individual electrodes 43*b* and the common electrode 44. The electrode pair of the individual electrode 43*a* and the common electrode 44 and the electrode pair of the individual electrode 43*b* and the common electrode 44 correspond to the pair of electrodes according to the present invention for applying the voltage to the piezoelectric layer 42 respectively.

Figure 7A:
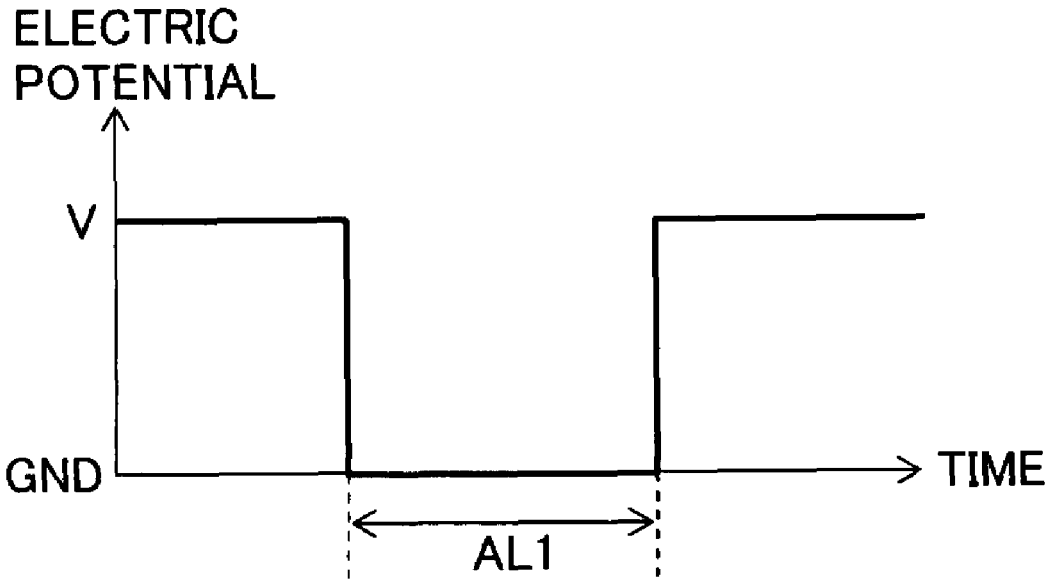
FIGS. 7A and 7B show time-dependent changes of the electric potential to be applied to the individual electrode.
Figure 7B:
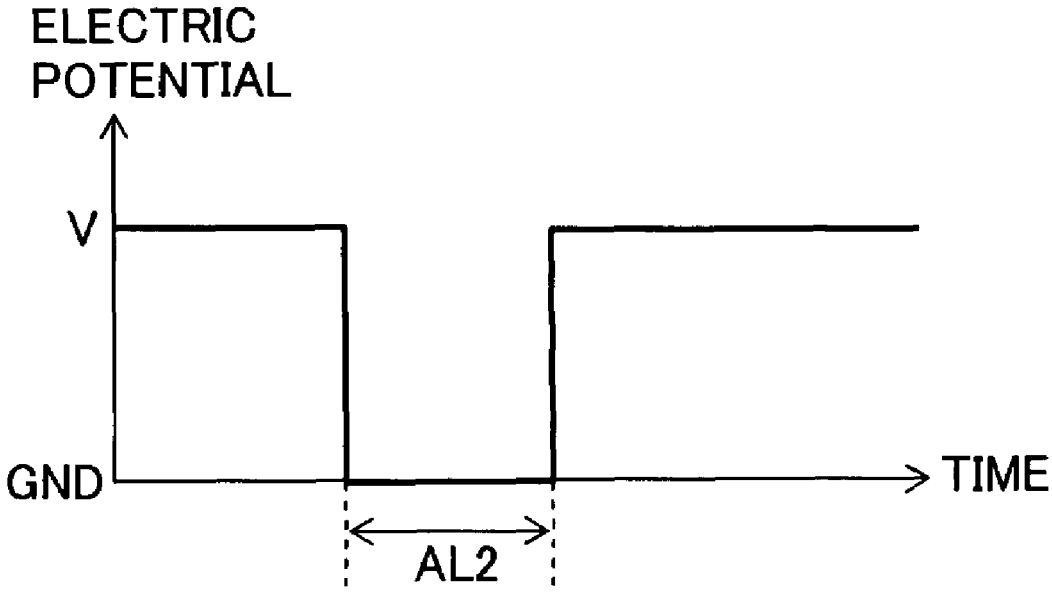

A method for driving the piezoelectric actuator 31 will be explained below. FIG. 7A shows the time-dependent change of the electric potential to be applied to the individual electrode 43*a* when the piezoelectric actuator 31 is driven. FIG. 7B shows the time-dependent change of the electric potential to be applied to the individual electrode 43*b* when the piezoelectric actuator 31 is driven.

As shown in FIGS. 7A and 7B, in the piezoelectric actuator 31 in a state in which the ink droplets are not jetted, the driving electric potential V is previously applied to the individual electrodes 43*a*, 43*b* as shown in FIGS. 7A and 7B. Accordingly, the difference in the electric potential is generated between the individual electrodes 43*a*, 43*b* and the common electrode 44 (voltage is applied to the piezoelectric layer 42). The electric fields are generated in the thickness direction at the portions of the piezoelectric layer 42 interposed between the individual electrodes 43*a*, 43*b* and the common electrode 44. The direction of the electric field is coincident with the direction of polarization of the piezoelectric layer 42. Therefore, the portions of the piezoelectric layer 42 interposed between the electrodes are shrunk in the horizontal direction (surface direction of the piezoelectric layer 42) perpendicular to the thickness direction. As a result of the shrinkage, the vibration plate 40 is deformed to be convex in the pressure chambers 10*a*, 10*b*.

When the ink droplets are jetted from the nozzles 15*a*, 15*b*, the individual electrodes 43*a*, 43*b*, which correspond to the nozzles 15*a*, 15*b*, are firstly set to the ground electric potential. In this situation, the deformations of the portions of the vibration plate 40 facing the pressure chambers 10*a*, 10*b* corresponding to the individual electrodes 43*a*, 43*b* are restored. The volumes of the pressure chambers 10*a*, 10*b* are increased (restored), and the pressures of the inks are decreased in the pressure chambers 10*a*, 10*b*. Accordingly, the inks are allowed to inflow from the manifold channels 11*a*, 11*b* into the pressure chambers 10*a*, 10*b* respectively.

Subsequently, after the elapse of a predetermined period of time, the driving electric potential V is applied again to the individual electrodes 43*a*, 43*b* allowed to be at the ground electric potential. In this situation, the vibration plate 40 is deformed to be convex in the pressure chambers 10*a*, 10*b*, and the volumes of the pressure chambers 10*a*, 10*b* are decreased in the same manner as described above. Accordingly, the pressures of the inks are increased in the pressure chambers 10*a*, 10*b* (pressures are applied to the inks contained in the pressure chambers 10*a*, 10*b* in order to perform the jetting operation). The ink droplets are jetted from the nozzles 15*a*, 15*b* communicated with the pressure chambers 10*a*, 10*b*.

As described above, the ink-jet head 3 performs the so-called pull type jetting operation (pulling ejection). That is, the volume of the pressure chamber 10*a*, 10*b* is once increased, and then the volume of the pressure chamber 10*a*, 10*b* is decreased. The pressure is applied to the ink contained in the pressure chamber 10*a*, 10*b* to discharge the ink. When the pulling ejection is performed, the predetermined period of time, which ranges from the arrival of the individual electrode 43*a*, 43*b* at the ground electric potential to the application of the driving electric potential V to the individual electrode 43*a*, 43*b* again, is adjusted to the period of time until the negative pressure wave, which is generated in the pressure chamber 10*a*, 10*b* when the individual electrode 43*a*, 43*b* is allowed to be at the ground electric potential, is inverted into the positive and returned. Accordingly, the ink droplets can be efficiently jetted from the nozzles 15*a*, 15*b*.

In this arrangement, the individual ink channel 32*a* and the manifold channel 11*a* have the same channel structures as those of the individual ink channel 32*b* and the manifold channel 11*b* respectively. The thickness of the portion of the piezoelectric layer 42 facing the pressure chamber 10*a* is thinner than the thickness of the portion facing the pressure chamber 10*b*, and the rigidity of the former is smaller than that of the latter. In relation thereto, according to an experiment performed by the inventors, the following fact has been revealed. That is, the transmission velocity of the pressure wave is also affected by the rigidity of each of the plates for constructing the channel, in addition to, for example, the natural frequency of the ink, the length of the ink channel of the cavity plate, and the channel resistance. In the embodiment of the present invention, the following fact has been revealed. That is, the transmission velocity of the pressure wave between the pressure chamber 10*a* and the manifold channel 11*a* is slower than the transmission velocity of the pressure wave between the pressure chamber 10*b* and the manifold channel 11*b* as a result of the fact that the thickness of the portion of the piezoelectric layer 42 facing the pressure chamber 10*a* is thinner than the thickness of the portion facing the pressure chamber 10*b*, and the rigidity of the former is lowered as compared with the latter. In other words, the period of time AL1, which is required until the negative pressure wave generated in the pressure chamber 10*a* is inverted to the positive and returned, is longer than the period of time AL2 which is required until the negative pressure wave generated in the pressure chamber 10*b* is inverted to the positive and returned. According to a knowledge of the inventors, when the pulling ejection is performed, the following fact is acknowledged. That is, the longer the period of time until the negative pressure wave generated in the pressure chamber is inverted to the positive and returned is, the larger the volume of the ink droplet jetted from the nozzle is. Also in the case of the ink-jet head of this embodiment, the volume of the black ink droplet jetted from the nozzle 15*a* is larger than the volume of the color ink droplet jetted from the nozzle 15*b*. In this embodiment, the time AL1 is about 7 μs, and the time AL2 is about 4.5 μs.

The rigidity of the portion of the piezoelectric layer 42 facing the pressure chamber 10*a* is smaller than the rigidity of the portion facing the pressure chamber 10*b*. Therefore, the portion of the vibration plate 40 facing the pressure chamber 10*a* is greatly deformed as compared with the portion facing the pressure chamber 10*b*. Accordingly, the change of the volume of the pressure chamber 10*a* is larger than the change of the volume of the pressure chamber 10*b*. Accordingly, the volume of the black ink droplet jetted from the nozzle 15*a* is larger the volume of the color ink droplet jetted from the nozzle 15*b*.

Further, the thickness of the portion of the piezoelectric layer 42 facing the pressure chamber 10*a* is thinner than the thickness of the portion of the piezoelectric layer 42 facing the pressure chamber 10*b*. Therefore, when the identical driving electric potential V is applied to the individual electrodes 43*a*, 43*b*, the electric field intensity, which is applied to the portion of the piezoelectric layer 42 interposed between the individual electrode 43*a* and the common electrode 44, is larger than the electric field intensity which is applied to the portion of the piezoelectric layer 42 interposed between the individual electrode 43*b* and the common electrode 44. Accordingly, the amount of shrinkage in the horizontal direction, which is provided at the portion of the piezoelectric layer 42 interposed between the individual electrode 43*a* and the common electrode 44, is larger than the amount of shrinkage in the horizontal direction which is provided at the portion of the piezoelectric layer 42 interposed between the individual electrode 43*b* and the common electrode 44. Therefore, the portion of the vibration plate 40 facing the pressure chamber 10 is deformed more greatly as compared with the portion facing the pressure chamber 10*b*. The volume of the pressure chamber 10*a* is changed more greatly as compared with the volume of the pressure chamber 10*b*. Therefore, the volume of the black ink droplet jetted from the nozzle 15*a* is further increased as compared with the volume of the color ink droplet jetted from the nozzle 15*b*. In this embodiment, as described later, when the thicknesses of the vibration plate and the individual electrode are adjusted to thereby lower the rigidity of the portion, of the piezoelectric layer and the individual electrode, facing the pressure chamber 10*a* than the rigidity of the another portion, of the piezoelectric layer and the individual electrode, facing the pressure chamber 10*b*, the volume of the black ink droplet jetted from the nozzle 15*a* is about 8 pl, and the volume of the color ink droplet jetted from the nozzle 15*b* is about 5 pl. Further, when the thickness of the portion, of the piezoelectric layer 42, facing the pressure chamber 10*a* is thinner than the thickness of the another portion, of the piezoelectric layer 42, facing the pressure chamber 10*b*, then the volume of the black ink droplet jetted from the nozzle 15*a* is about 10 pl, and the volume of the color ink droplet jetted from the nozzle 15*b* is about 5 pl. It is considered that this increase in the volume of the black ink droplet is caused by the reduction in rigidity of the piezoelectric layer and the increase in intensity of the electric field in the piezoelectric layer.

As described above, the volume of the black ink droplet jetted from the nozzle 15*a* is larger than the volume of the color ink droplet jetted from the nozzle 15*b*. Therefore, when the monochrome printing (black and white printing) is performed, the printing can be performed at a high speed by jetting the black ink droplets having the large volume from the nozzles 15*a*. When the color printing is performed, the printing can be performed at a high image quality by jetting the color ink droplets having the small volume from the nozzles 15*b*.

The piezoelectric actuator includes the piezoelectric actuator of the unimorph type such as the piezoelectric actuator 31 of this embodiment, as well as the stacked type piezoelectric actuator. In the case of the stacked type piezoelectric actuator, a plurality of piezoelectric layers are stacked on the upper surface of a channel unit, and individual electrodes and common electrodes are alternately arranged between the respective piezoelectric layers. The volume of the pressure chamber is directly changed by means of the deformation of the piezoelectric layer in the thickness direction. In the embodiment of the present invention, it is impossible to use such a stacked type piezoelectric actuator in place of the piezoelectric actuator 31, for the following reason. That is, in relation to the stacked type piezoelectric actuator, it is known that the relationship of $d_{33}=m/V$ is given among the displacement amount m of each of the piezoelectric layers, the piezoelectric constant $d_{33}$ which is determined by the material for constructing the piezoelectric layer, and the voltage V which is applied to the piezoelectric layer. That is, the displacement amount m of each of the piezoelectric layers is the amount depending on $d_{33}$ as the constant inherent in the piezoelectric material and the voltage V applied to each of the piezoelectric layers. The displacement amount m is not the amount depending on the thickness of each of the piezoelectric layers. When the number of the stacked piezoelectric layers and the applied voltage are identical, the amounts of change of the volumes of the pressure chambers 10*a*, 10*b* are approximately identical with each other even when the thickness of the piezoelectric layer is changed. In view of the above, the unimorph type piezoelectric actuator 31 is especially used in the embodiment of the present invention.

Next, a method for producing the ink-jet head 3 will be explained with reference to FIG. 8. FIG. 8 shows the steps of producing the ink-jet head 3.

Figure 8A:
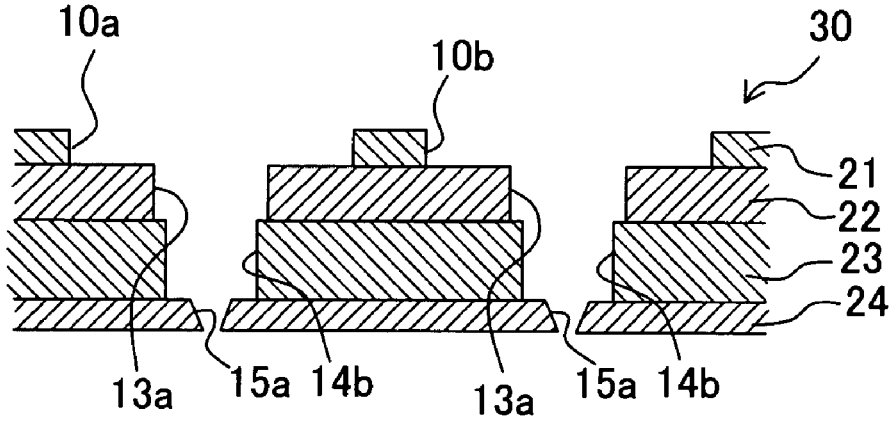
FIGS. 8A to 8C show a former half of the steps of producing the ink-jet head.

In order to produce the ink-jet head 3, at first, base members made of metal, which are to be formed into the plates 21 to 23, are prepared. The pressure chambers 10*a* and the pressure chambers 10*b*, which have the same shape, are formed for the prepared base members, for example, by means of the etching. Further, the holes, which are to be formed into the ink channels including, for example, the manifold channels 11*a* and the manifold channels 11*b*, are formed. On the other hand, another base member made of synthetic resin material, which is to be formed into the nozzle plate 24, is prepared. The nozzles 15*a*, 15*b* are formed through the base member by means of the laser machining. As shown in FIG. 8A, the plates 21 to 24 are stacked to form the channel unit 30 (channel unit-forming step). Accordingly, the first channels having the individual ink channels 32*a* and the manifold channels 11*a*, and the second channels having the same channel structure as that of the first channels and having the individual ink channels 32*b* and the manifold channels 11*b* as described above are formed in the channel unit 30. When the nozzle plate 24 is made of the metal material, the nozzles 15*a*, 15*b* can be formed by applying the press working with respect to a base member made of metal to be formed into the nozzle plate 24.

Figure 8B:
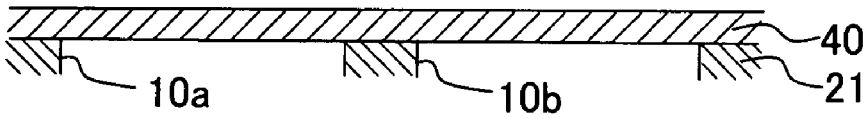
Figure 8C:
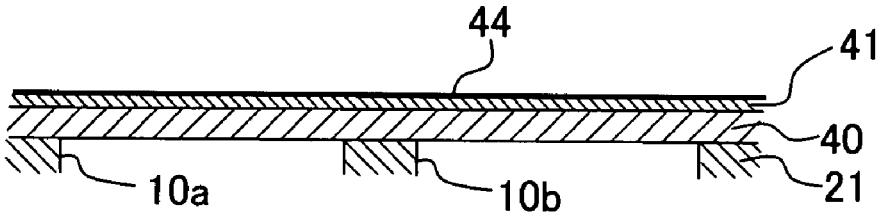

Subsequently, as shown in FIG. 8B, the vibration plate 40 is joined to the upper surface of the channel unit 30 (joining step). Subsequently, as shown in FIG. 8C, the insulating layer 41 is formed on the upper surface of the vibration plate 40 by means of the sputtering method. Further, the common electrode 44 is formed on the upper surface thereof, for example, by means of the printing.

Figure 9A:
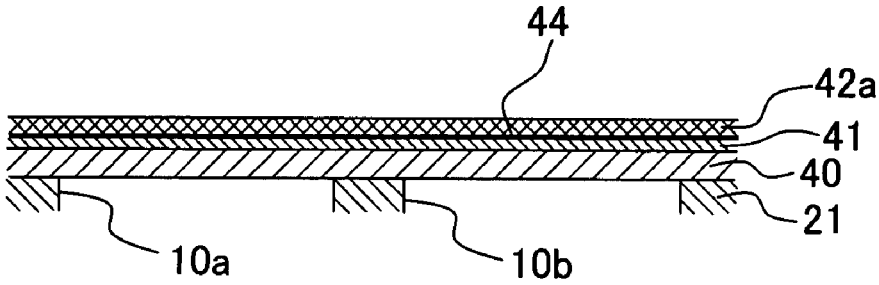
FIGS. 9A to 9C show a latter half of the steps of producing the ink-jet head.
Figure 9B:
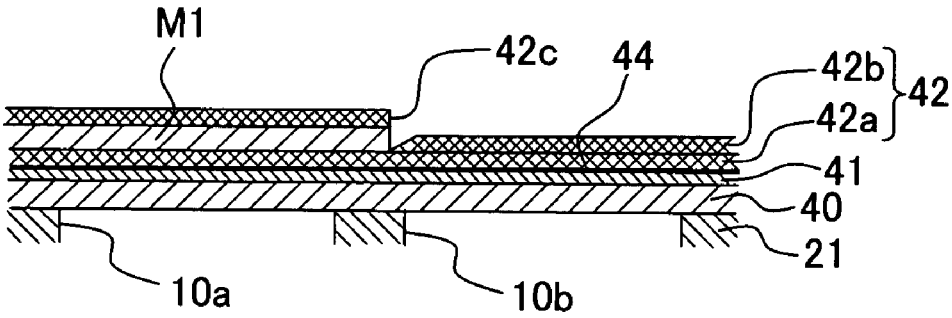
Figure 9C:
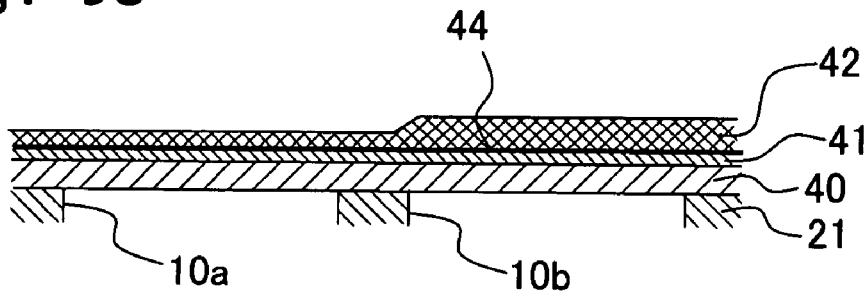

Subsequently, as shown in FIG. 9A, particles of piezoelectric material are deposited by means of the sputtering method (particle deposition method) on the surface of the vibration plate 40 (predetermined base member) provided with the insulating layer 41 formed on the surface to form the piezoelectric layer 42*a* having a substantially constant thickness. As described later on, the piezoelectric layer 42*a* corresponds to a substantially lower half portion of the piezoelectric layer 42. Subsequently, as shown in FIG. 9B, the portions of the upper surface of the piezoelectric layer 42*a* except for the portions facing the pressure chamber arrays 8*b* and the vicinity thereof are covered with the mask M1. The piezoelectric layer 42*b*, which has a substantially constant thickness, is further formed thereon by means of the sputtering method. The piezoelectric layer 42*b* constitutes an upper half portion of the piezoelectric layer 42. When the mask M1 is removed, as shown in FIG. 9C, the piezoelectric layer 42 is formed, in which the thickness is thinned at the portions facing the pressure chamber arrays 8*a* (pressure chambers 10*a*) and the vicinity thereof as compared with the portions facing the pressure chamber arrays 8*b* (pressure chambers 10*b*) and the vicinity thereof. After that, an annealing treatment is performed to heat the piezoelectric layer 42 so that the sufficient piezoelectric characteristic is given to the piezoelectric layer 42.

In this arrangement, the pressure chamber arrays 8*a*, 8*b* include the plurality of pressure chambers 10*a*, 10*b* respectively. Both of the areas of the upper surface of the vibration plate 40 facing the pressure chamber arrays 8*a* and the vicinity thereof and the areas facing the pressure chamber arrays 8*b* and the vicinity thereof are the areas having the relatively large areal sizes. Therefore, the piezoelectric layer 42 can be formed with ease, in which the thickness differs between the portions facing the pressure chamber arrays 8*a* and the vicinity thereof and the portions facing the pressure chamber arrays 8*b* and the vicinity thereof.

Further, when the sputtering method is used, the thicknesses of the piezoelectric layers 42*a*, 42*b* can be changed freely. Therefore, it is easy to form the piezoelectric layer 42 having the desired thickness.

After that, the plurality of individual electrodes 43*a*, 43*b* are formed on the surface of the piezoelectric layer 42, for example, by means of the printing. Accordingly, the ink-jet head 3 is produced as shown in FIGS. 2 to 6. The steps of forming the insulating layer 41, the common electrode 44, the piezoelectric layer 42, and the individual electrodes 43*a*, 43*b* on the upper surface of the vibration plate 40 correspond to the piezoelectric actuator-forming step.

According to the embodiment explained above, the thickness of the piezoelectric layer 42 at the portions facing the pressure chamber arrays 8*a* and the vicinity thereof is formed to be thinner than the thickness of the piezoelectric layer 42 at the portions facing the pressure chamber arrays 8*b* and the vicinity thereof. Accordingly, the rigidity of the portion of the piezoelectric actuator 31 facing the pressure chamber 10*a* is smaller than the rigidity of the portion facing the pressure chamber 10*b*. In this arrangement, even if the first channel of the channel unit 30, including the individual ink channel 32*a* and the manifold channel 11*a*, and the second channel, including the individual ink channel 32*b* and the manifold channel 11*b*, are formed to have the same channel structure, when the same driving electric potential V is applied to the individual electrode 43*a* and the individual electrode 43*b*, then the portion of the vibration plate 40 facing the pressure chamber 10*a* is deformed more largely as compared with the portion facing the pressure chamber 10*b*. Accordingly, the volume of the pressure chamber 10*a* can be also changed more largely as compared with the volume of the pressure chamber 10*b*. The volume of the ink droplet jetted from the nozzle 15*a* can be made larger than the volume of the ink droplet jetted from the nozzle 15*b*.

In this embodiment, the ink droplets are jetted from the nozzles 15*a*, 15*b* by means of the pull type jetting operation (pulling ejection). As described above, the velocity of transmission of the pressure wave in the pressure chamber 10*a* is slower than the velocity of transmission of the pressure wave in the pressure chamber 10*b*. Therefore, the volume of the black ink droplet jetted from the nozzle 15*a* communicated with the pressure chamber 10*a* is further larger than the volume of the color ink droplet jetted from the nozzle 15*b* communicated with the pressure chamber 10*b*.

The thickness of the piezoelectric layer 42 at the portion facing the pressure chamber 10*a* is thinner than the thickness of the piezoelectric layer 42 at the portion facing the pressure chamber 10*b*. Therefore, when the same voltage is applied between the individual electrode 43*a* and the common electrode 44 and between the individual electrode 43*b* and the common electrode 44, the electric field intensity, which is obtained at the portion of the piezoelectric layer 42 interposed between the individual electrode 43*a* and the common electrode 44, is larger than the electric field intensity which is obtained at the portion interposed between the individual electrode 43*b* and the common electrode 44. Accordingly, the amount of shrinkage in the horizontal direction, which is provided at the portion of the piezoelectric layer 42 interposed between the individual electrode 43*a* and the common electrode 44, is larger than the amount of shrinkage in the horizontal direction which is provided at the portion of the piezoelectric layer 42 interposed between the individual electrode 43*b* and the common electrode 44. Therefore, the amounts of deformation of the vibration plate 40, the insulating layer 41, the common electrode 44, and the piezoelectric layer 42, which are provided at the portion facing the pressure chamber 10*a*, are larger than the amounts of deformation thereof which are provided at the portion facing the pressure chamber 10*b*. Therefore, the volume of the black ink droplet jetted from the nozzle 15*a* is more larger than the volume of the color ink droplet jetted from the nozzle 15*b*.

The black ink droplets are jetted from the nozzles 15*a*, and the color ink droplets are jetted from the nozzles 15*b*. Accordingly, when the monochrome printing is performed, the printing can be performed at a high speed by jetting the black ink droplets having the large volume from the nozzles 15*a*. When the color printing is performed, the printing can be performed at a high image quality by jetting the color ink droplets having the small volume from the nozzles 15*b*.

The plurality of pressure chamber arrays 8*a* include the plurality of pressure chambers 10*a* respectively, and the plurality of pressure chamber arrays 8*b* include the plurality of pressure chambers 10*b* respectively. Therefore, the area of the upper surface of the piezoelectric layer 42 facing the pressure chamber arrays 8*a* and the vicinity thereof and the area facing the pressure chamber arrays 8*b* and the vicinity thereof have the relatively large areal sizes respectively. Therefore, when the piezoelectric layer 42*a* is firstly formed over the entire region of the surface of the common electrode 41, the portion of the upper surface of the piezoelectric layer 42*a* is subsequently covered with the mask M1 except for the portion facing the pressure chamber arrays 8*b* and the vicinity thereof, and the piezoelectric layer 42*b* is formed by means of the sputtering method from the upper surface of the piezoelectric layer 42*a*, then the thickness of the piezoelectric layer 42 can be changed with ease between the portion facing the pressure chamber arrays 8*a* and the vicinity thereof and the portion facing the pressure chamber arrays 8*b* and the vicinity thereof.

In this procedure, the thicknesses of the piezoelectric layers 42*a*, 42*b* can be freely changed by means of the sputtering method as the particle deposition method. Therefore, the piezoelectric layer 42 can be formed more easily.

In the channel unit 30, the channel structures of the manifold channel 11*a* and the individual ink channel 32*a* are the same as the channel structures of the manifold channel 11*b* and the individual ink channel 32*b* respectively. Therefore, any ink-jet head 3, which differs in the positions of the nozzles 15*a* and the nozzles 15*b* and the ratio between the numbers of the nozzles 15*a* and the nozzles 15*b*, can be constructed by using the identical channel unit 30.

In the embodiment described above, the vibration plate 40 is joined to the channel unit 30, and then the piezoelectric layer 42 is formed on the upper surface of the vibration plate 40. After that, the annealing treatment is performed to heat the piezoelectric layer 42. In this procedure, in the annealing treatment, the heating is performed at a high temperature of several hundreds of degrees or more. Therefore, when the nozzle plate 24 is formed of the synthetic resin material, it is feared that the nozzle plate 24 may be deformed during the annealing treatment. Accordingly, in this case, the following procedure is preferably adopted. That is, in the channel unit-forming step, the plates 21 to 23 except for the nozzle plate 24 are joined to one another to form the channel unit 30. The nozzle plate 24 is joined to the channel unit 30 after the annealing treatment is completed.

When the plates 21 to 24 composed of the metal material are joined to one another with the adhesive, it is feared that the adhesive may be melted and the plates 21 to 24 may be separated from each other during the annealing treatment to be performed thereafter. Therefore, it is preferable that the plates 21 to 24 are joined to one another by means of the diffusion bonding.

Next, modified embodiments, in which various changes are made to the embodiment of the present invention, will be explained. However, those constructed in the same manner as in the embodiment of the present invention are designated by the same reference numerals, any explanation of which will be appropriately omitted.

First Modification

Figure 10A:
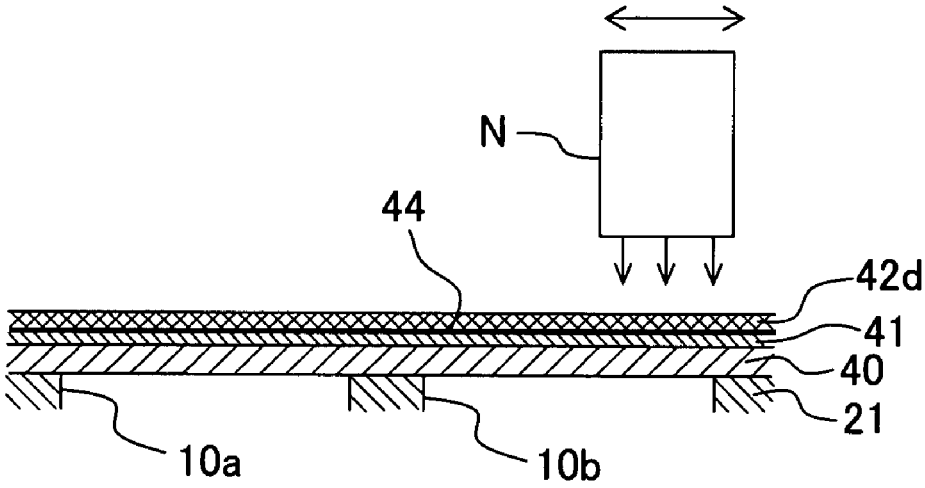
FIGS. 10A and 10B show a sectional view illustrating a first modification corresponding to FIGS. 9A and 9B, respectively.
Figure 10B:
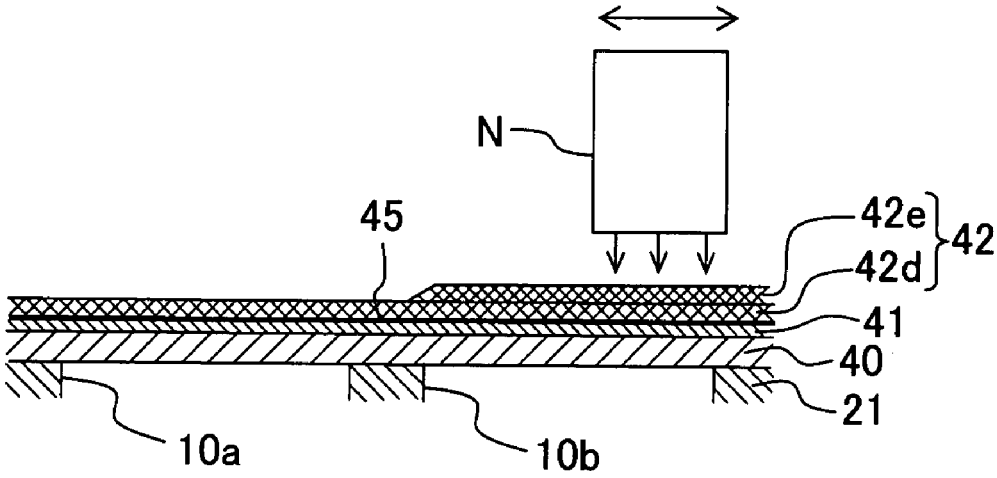

In the embodiment of the present invention, the piezoelectric layer 42 is formed by means of the sputtering method. However, the piezoelectric layer 42 may be formed by means of the aerosol deposition method (AD method) as another particle deposition method. In this procedure, the insulating layer 41 and the common electrode 44 are formed on the upper surface of the vibration plate 40. After that, as shown in FIG. 10A, particles of the piezoelectric material are jetted from a film formation nozzle N while scanning the film formation nozzle N for jetting the particles of the piezoelectric material over the entire region of the vibration plate 40 on which insulating layer 41 and the common electrode 44 are formed. Accordingly, a piezoelectric layer 42*d*, which has a substantially constant thickness and which constitutes a substantially lower half of the piezoelectric layer 42, is formed. Subsequently, as shown in FIG. 10B, the particles of the piezoelectric material are jetted from the film formation nozzle N while scanning the film formation nozzle N over the portions facing the pressure chamber arrays 8*b* and the vicinity thereof over the piezoelectric layer 42*d*. Accordingly, a piezoelectric layer 42*e*, which has a substantially constant thickness and which constitutes a substantially upper half of the piezoelectric layer 42, is formed at the portions of the upper surface of the piezoelectric layer 42*d* facing the pressure chamber arrays 8*b* and the vicinity thereof. Alternatively, the piezoelectric layer 42 may be formed as follows. That is, the particles of the piezoelectric material are jetted from the film formation nozzle N while scanning the film formation nozzle N over the entire region of the vibration plate 40 on which the insulating layer 41 and the common electrode 44 are formed. When the film formation nozzle N arrives at the position facing the pressure chamber arrays 8*b* and the vicinity thereof, the jetting amount of the particles of the piezoelectric material is increased. Further alternatively, the piezoelectric layer 42 may be formed by means of any particle deposition method (for example, CVD) other than the sputtering method and the AD method.

Second Modification

Figure 11:
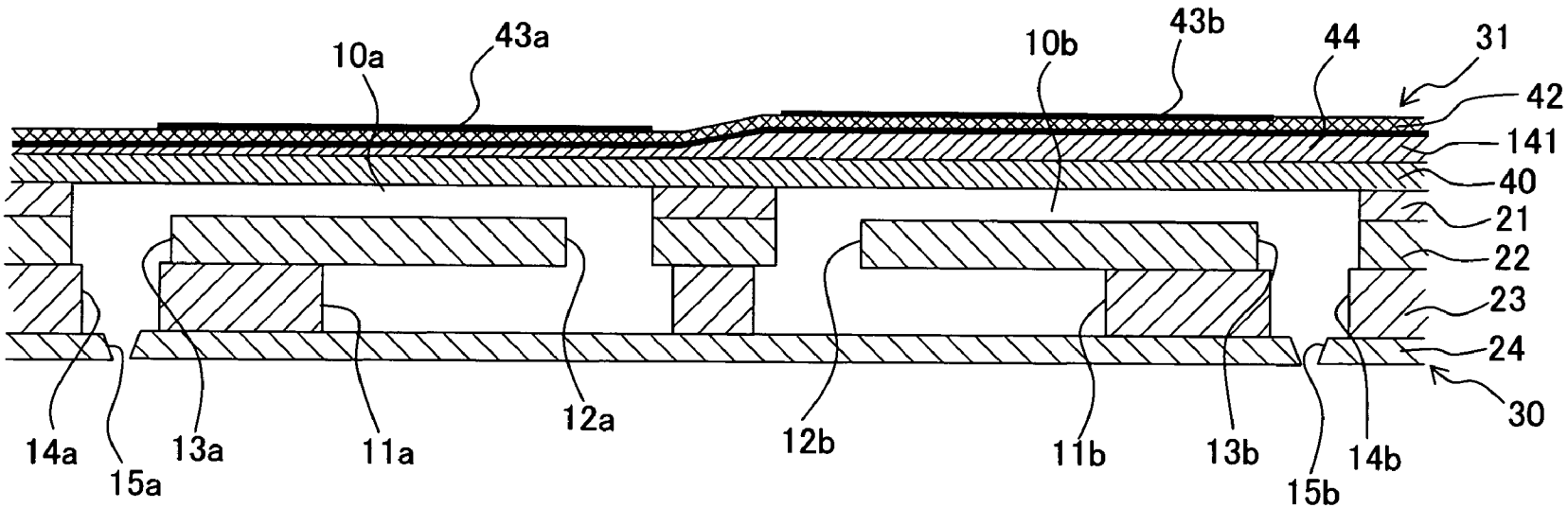
FIG. 11 shows a sectional view illustrating a second modification corresponding to FIG. 4.

In the embodiment of the present invention, the thickness of the piezoelectric layer 42 is changed between the portion facing the pressure chamber 10*a* and the portion facing the pressure chamber 10*b*. As shown in FIG. 11, the thickness of a portion of an insulating layer 141 facing the pressure chamber 10*a* may be thinner than the thickness of a portion of the insulating layer 141 facing the pressure chamber 10*b*. Also in this case, the rigidity of the piezoelectric actuator 31 is small at the portion facing the pressure chamber 10*a* as compared with the portion facing the pressure chamber 10*b*. Therefore, the volume of the black ink droplet jetted from the nozzle 15*a* can be made larger than the volume of the color ink droplet jetted from the nozzle 15*b* in the same manner as explained in the embodiment of the present invention. In this modification, the insulating layer 141, which has the different thicknesses, can be formed with ease by using the particle deposition method including, for example, the sputtering method and the AD method, in the same manner as in the formation of the piezoelectric layer 42 in the embodiment of the present invention and the modified embodiment described above.

Third Modification

Figure 12:
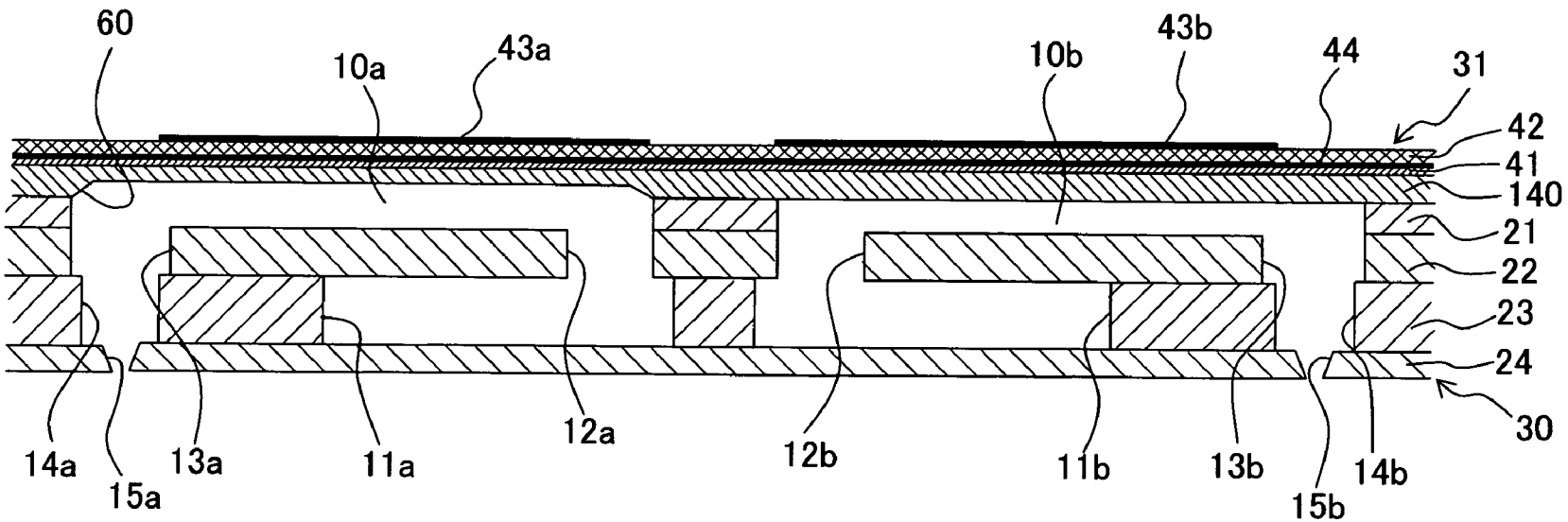
FIG. 12 shows a sectional view illustrating a third modification corresponding to FIG. 4.

As shown in FIG. 12, a recess 60 may be formed at a portion of the lower surface (one surface) of a vibration plate 140 facing the pressure chamber 10*a*, and thus the thickness of the portion of the vibration plate 140 facing the pressure chamber 10*a* may be thinned as compared with a portion facing the pressure chamber 10*b*. Also in this case, the rigidity of the portion of the piezoelectric actuator 31 facing the pressure chamber 10*a* is smaller than the rigidity of the portion facing the pressure chamber 10*b*. Therefore, the volume of the black ink droplet jetted from the nozzle 15*a* can be made larger than the volume of the color ink droplet jetted from the nozzle 15*b* in the same manner as explained in the embodiment of the present invention described above. In this modification, when the piezoelectric actuator 31 is formed (in the piezoelectric actuator-forming step), the recesses 60 are formed on the vibration plate 140, for example, by means of the half etching (recess-forming step). After that, the vibration plate 140 is joined to the channel unit 30 so that the recesses 60 are facing the pressure chambers 10*a* (joining step). In this modification, the portion of the pressure chamber 10*a* constructed by the channel unit 30, i.e., the portion except for the recess 60 corresponds to the first pressure chamber of the present invention. The first channel according to the present invention and the second channel according to the present invention have the same channel structure in the same manner as in the embodiment of the present invention. The recesses may be formed on the upper surface of the vibration plate 140.

Alternatively, the individual electrode 43*a* may be formed to have a thickness different from that of the individual electrode 43*b*. The portion of the common electrode 44 facing the pressure chamber 10*a* and the portion facing the pressure chamber 10*b* may have mutually different thicknesses. Also in this case, the portion of the piezoelectric actuator 31 facing the pressure chamber 10*a* is thinner than the portion facing the pressure chamber 10*b*.

Fourth Modification

Figure 13A:
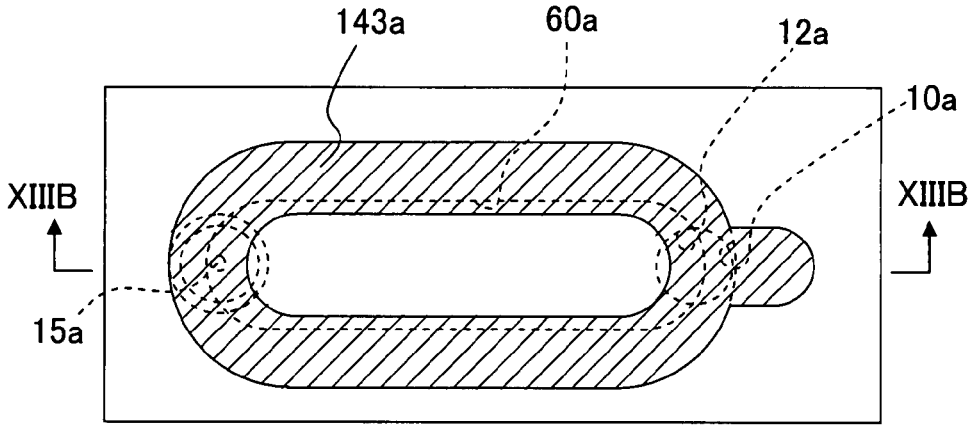
FIG. 13A shows a magnified view illustrating a forth modification corresponding to FIG. 3.
Figure 13B:
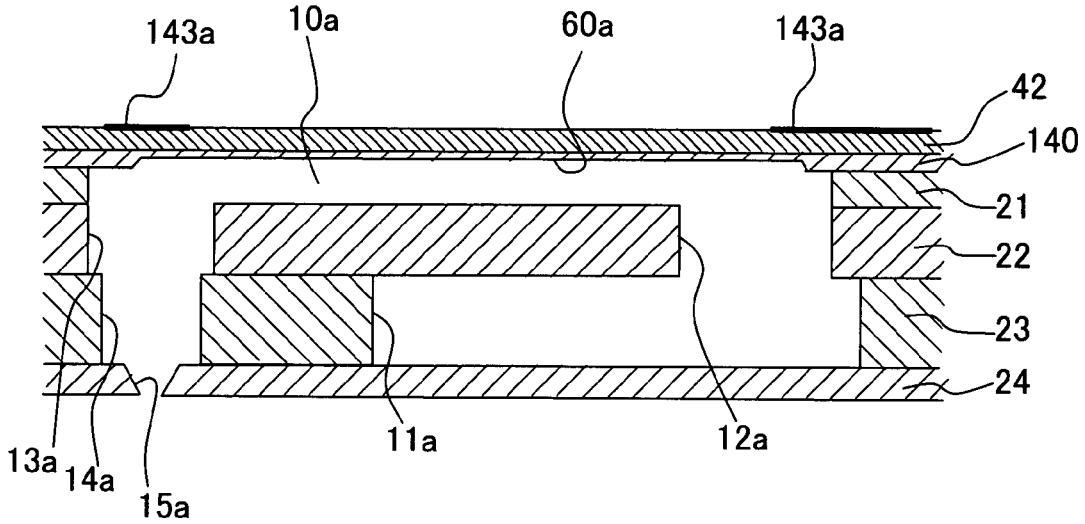
FIG. 13B shows a sectional view taken along a line XIIIB-XIIIB shown in FIG. 13A.

As shown in FIGS. 13A and 13B, individual electrodes 143*a*, 143*b* may have ring-shaped forms, and portions of the individual electrodes 143*a*, 143*b* are not formed in areas of the piezoelectric layer 42 overlapped with substantially central portions of the pressure chambers 10*a*, 10*b*. Further, a recess 60*a* may be formed in an area of the vibration plate 140 overlapped with the substantially central portion of the pressure chamber 10*a*. Since the shapes of the individual electrodes 143*a*, 143*b* are of the ring type, the portion of the piezoelectric layer 42, which is overlapped with the central portion of the pressure chamber (portion disposed at the center of the ring-shaped individual electrode at which no electrode is formed), is deformed to be convex, when the voltage is applied to the electrodes. In other words, the piezoelectric actuator can be deformed so that the volume of the pressure chamber is increased when the voltage is applied to the ring-shaped individual electrode 143*a*, 143*b*. The ink can be discharged by performing the pull type jetting operation. In this procedure, it is unnecessary to previously apply the voltage during the period in which the liquid droplets are not discharged. It is possible to avoid the deterioration of the piezoelectric layer, and it is possible to reduce the electric power consumption. In the arrangement as described above, when the recess 60*a* is formed at the portion of the vibration plate 140 overlapped with the central portion of the pressure chamber 10*a*, the rigidity of the portion of the piezoelectric actuator facing the pressure chamber 10*a* can be lowered as compared with the rigidity of the portion facing the pressure chamber 10*b*. In this arrangement, a recess may be formed at a portion of the piezoelectric layer 42 overlapped with the pressure chamber 10*a* in addition to the vibration plate or in place of the vibration plate 140. Accordingly, the volume of the black ink droplet jetted from the nozzle 15*a* can be made larger than the volume of the color ink droplet jetted from the nozzle 15*b* in the same manner as explained in the embodiment described above.

Fifth Modification

Figure 14A:
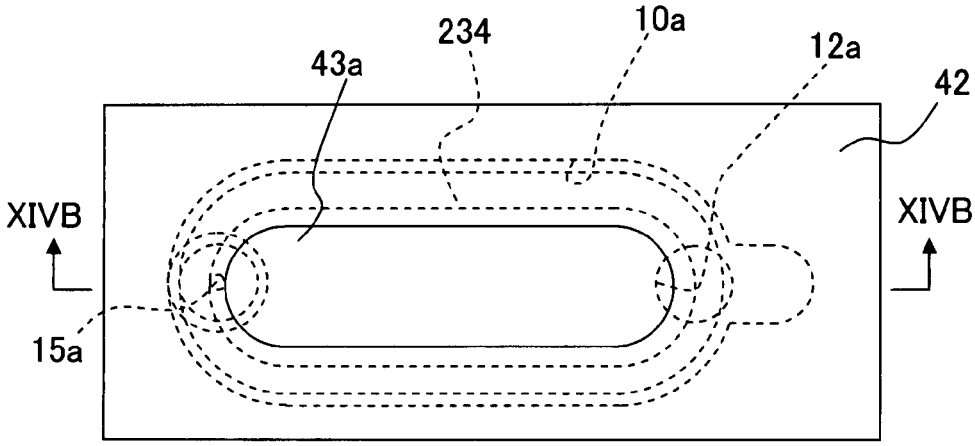
FIG. 14A shows a magnified view illustrating a fifth modification corresponding to FIG. 3.
Figure 14B:
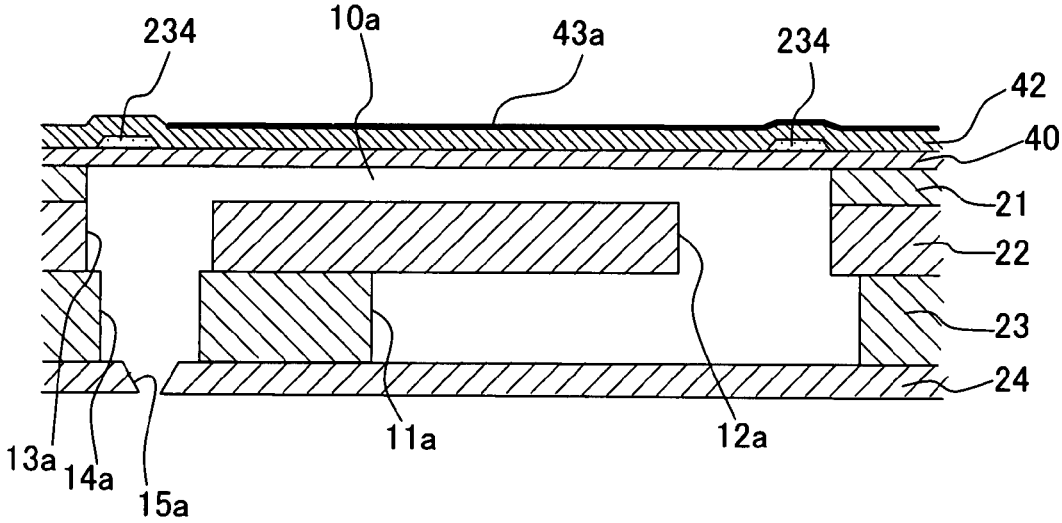
FIG. 14B shows a sectional view taken along a line XIVB-XIVB shown in FIG. 14A.

As shown in FIGS. 14A and 14B, an insulator layer 234, which is formed of, for example, a resin having the rigidity lower than those of the vibration plate 40 and the piezoelectric layer 42, may be arranged in an area overlapped with the outer edge portion of the pressure chamber 10*a* between the vibration plate 40 and the piezoelectric layer 42. When the insulator layer 234, which surrounds the outer edge of the pressure chamber 10*a*, is formed between the vibration plate 40 and the piezoelectric layer 42 as described above, the rigidity of the portion of the piezoelectric actuator facing the pressure chamber 10*a* can be lowered as compared with the rigidity of the portion facing the pressure chamber 10*b*. Accordingly, the volume of the black ink droplet jetted from the nozzle 15*a* can be made larger than the volume of the color ink droplet jetted from the nozzle 15*b* in the same manner as explained in the embodiment described above. It is also allowable that the insulator layer 234 does not surround the outer edge (periphery) of the pressure chamber 10*a* completely. The insulator layer 234 may be also formed at a portion facing the outer edge of the pressure chamber 10*b* between the vibration plate 40 and the piezoelectric layer 42. In this case, the rigidity of the portion of the piezoelectric actuator facing the pressure chamber 10*a* can be lowered as compared with the rigidity of the portion facing the pressure chamber 10*b*, for example, such that the insulator layer completely surrounds the pressure chamber 10*a*, while the insulator layer surrounds a part of the pressure chamber 10*b*.

Sixth Modification

Figure 15:
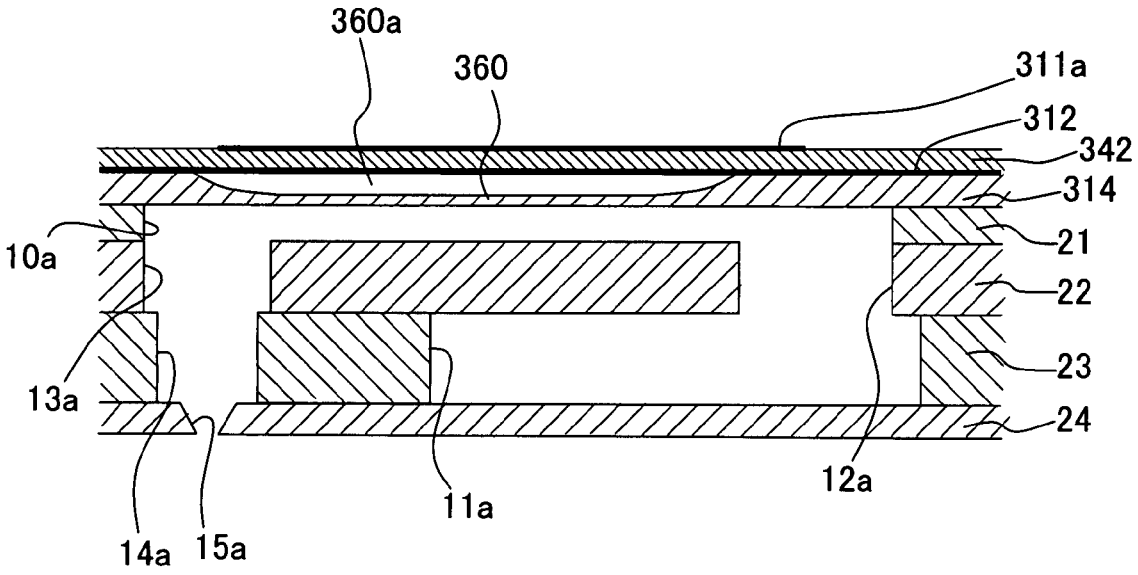
FIG. 15 shows a sectional view illustrating a first example of a sixth modification corresponding to FIG. 4.
Figure 16:
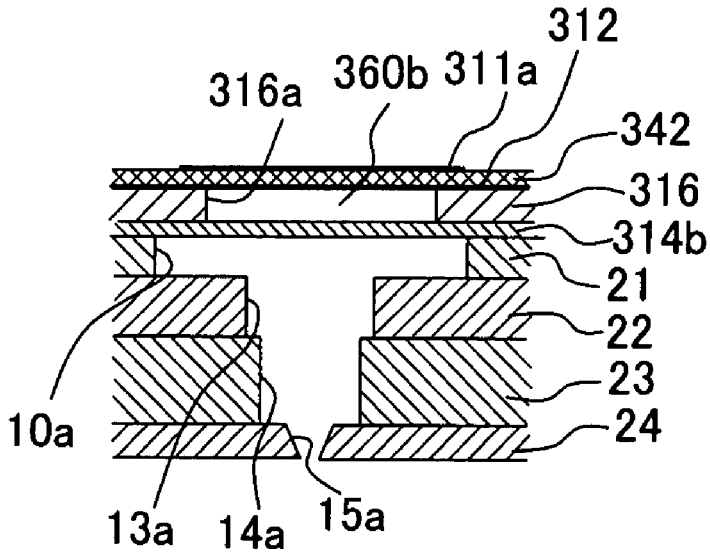
FIG. 16 shows a sectional view illustrating a second example of a sixth modification corresponding to FIG. 5.
Figure 17:
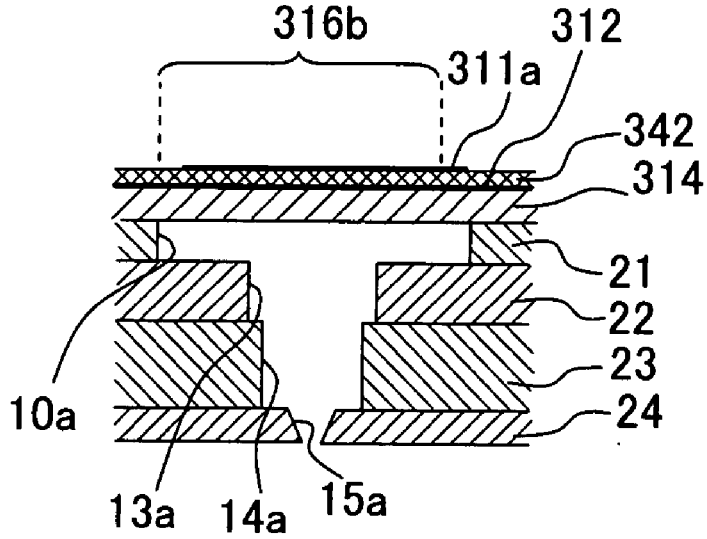
FIG. 17 shows a sectional view illustrating a third example of a sixth modification corresponding to FIG. 5.

In a piezoelectric actuator 301 shown in FIG. 15, an individual electrode 311*a* is formed at a portion of an upper surface of a piezoelectric layer 342 overlapped with the pressure chamber 10*a*, a common electrode 312 is formed on a lower surface of the piezoelectric layer 342, and a recess 360 is formed in an area of a vibration plate 314 overlapped with a substantially central portion of the pressure chamber 10*a*. In this arrangement, the vibration plate 314 and the common electrode 312 are secured to one another by means of an adhesive or by means of the diffusion bonding. However, the recess 360 is formed for the vibration plate 314. Therefore, a hollow space 360*a* is formed between the vibration plate 314 and the common electrode 312. Alternatively, as shown in FIG. 16, a hollow space 360*b* can be also formed by inserting a spacer 316 formed with a through-hole 316*a* in an area overlapped with a substantially central portion of the pressure chamber 10*a*, between a vibration plate 314*b* and the piezoelectric layer 342 formed with the individual electrode 311*a* and the common electrode 312. Further alternatively, as shown in FIG. 17, an unjoined portion 316*b*, in which the vibration plate 314 and the common electrode 312 are not secured to one another, may be formed in an area overlapped with a substantially central portion of the pressure chamber 10*a* between the vibration plate 314 and the common electrode 312. The hollow space 360*a*, 360*b* may be filled with a low rigidity material which is formed of, for example, a resin having the rigidity lower than those of the vibration plate 314 and the piezoelectric layer 342. In any case, the rigidity of the portion of the piezoelectric actuator 301 facing the area overlapped with the pressure chamber 10*a* can be lowered as compared with the rigidity of the portion facing the pressure chamber 10*b*. Accordingly, the volume of the black ink droplet jetted from the nozzle 15*a* can be made larger than the volume of the color ink droplet jetted from the nozzle 15*b* in the same manner as explained in the embodiment described above.

Seventh Modification

Figure 18A:
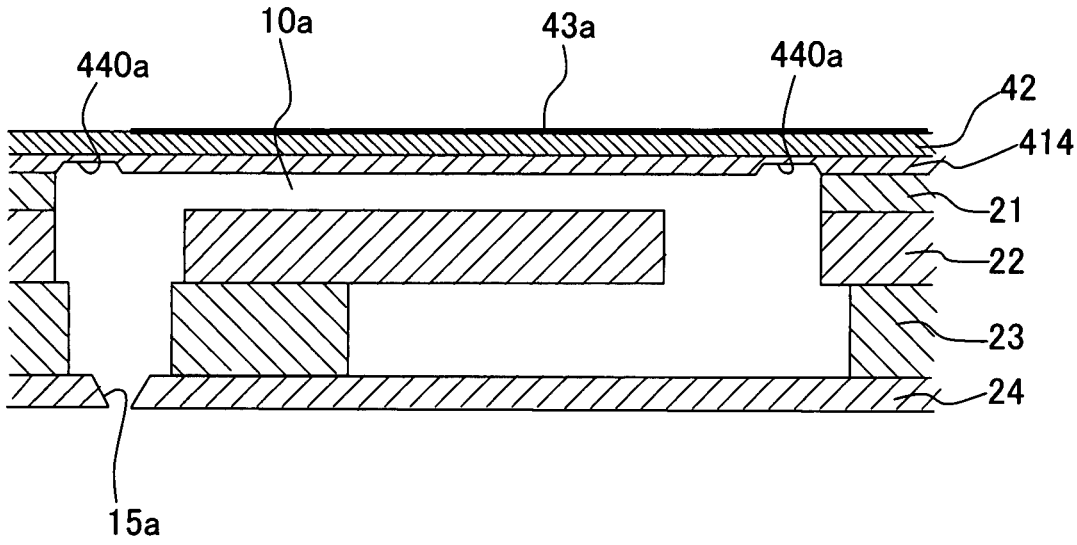
FIG. 18A shows a sectional view illustrating a first example of a seventh modification corresponding to FIG. 4
Figure 18B:
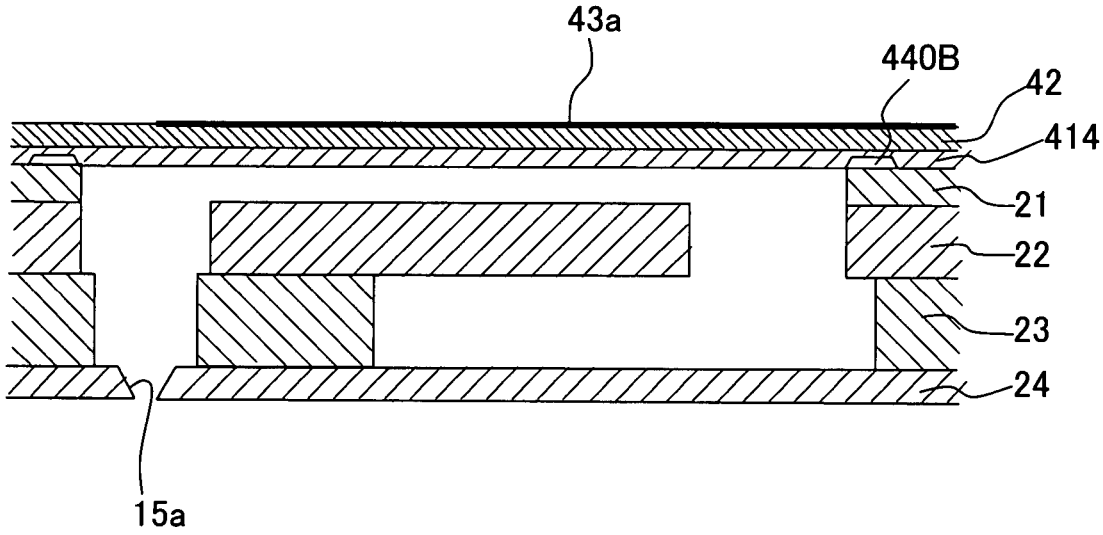
FIG. 18B shows a sectional view illustrating a second example of a seventh modification corresponding to FIG. 4.

As shown in FIG. 18A, a groove 440A may be formed at a portion of a vibration plate 414 overlapped with the outer edge portion of the pressure chamber 10*a*. Alternatively, as shown in FIG. 18B, a groove 440B may be formed in an area of a vibration plate 414 overlapped with the peripheral portion at the outside of the pressure chamber 10*a* (wall which defines the pressure chamber 10*a*). In any case, the rigidity of the portion of the piezoelectric actuator facing the area overlapped with the pressure chamber 10*a* can be lowered as compared with the rigidity of the portion facing the pressure chamber 10*b*. The groove may surround the outer circumference of the pressure chamber, or the groove may surround a part thereof. The groove may be filled with the low rigidity material as described above. Accordingly, the volume of the black ink droplet jetted from the nozzle 15*a* can be made larger than the volume of the color ink droplet jetted from the nozzle 15*b* in the same manner as explained in the embodiment described above.

Eighth Modification

Figure 19A:
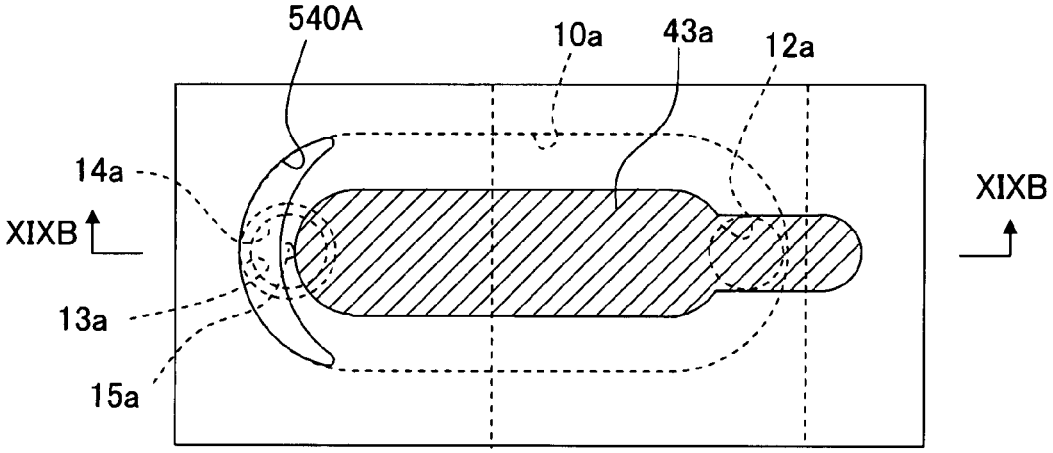
FIG. 19A shows a magnified view illustrating a first example of a eighth modification corresponding to FIG. 3
Figure 19B:
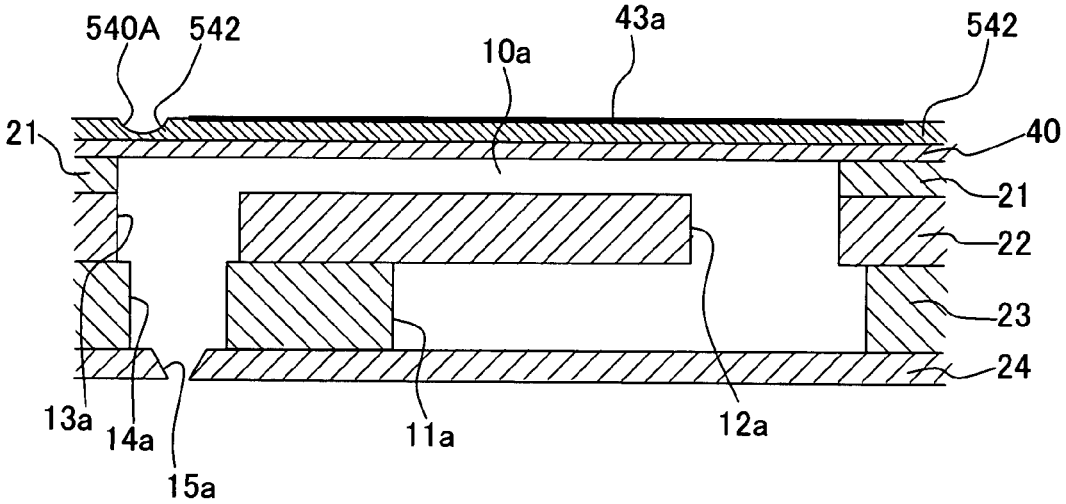
FIG. 19B shows a sectional view taken along a line XIXB-XIXB shown in FIG. 19A.
Figure 20A:
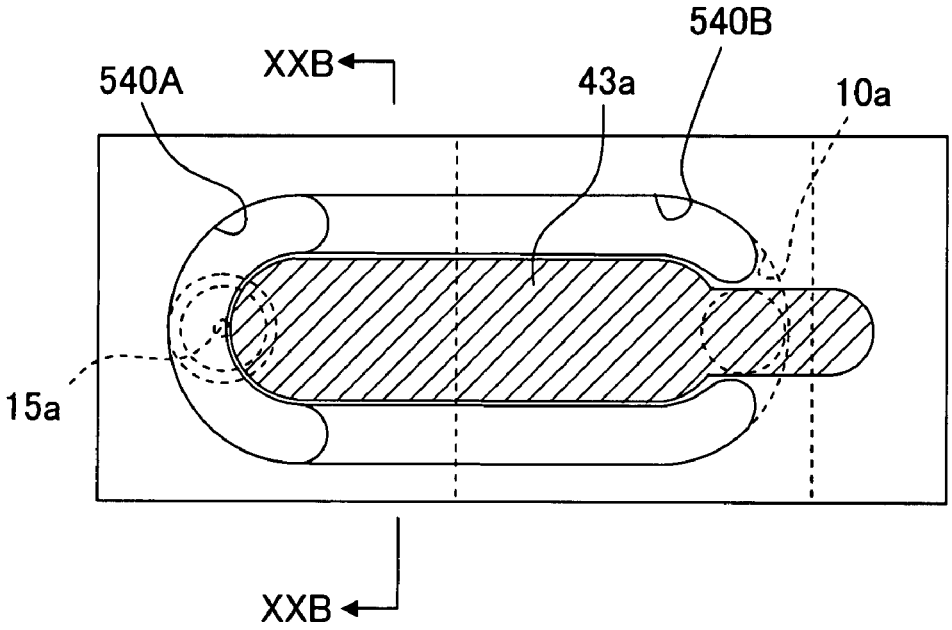
FIG. 20A a magnified view illustrating a second example of a eighth modification corresponding to FIG. 3
Figure 20B:
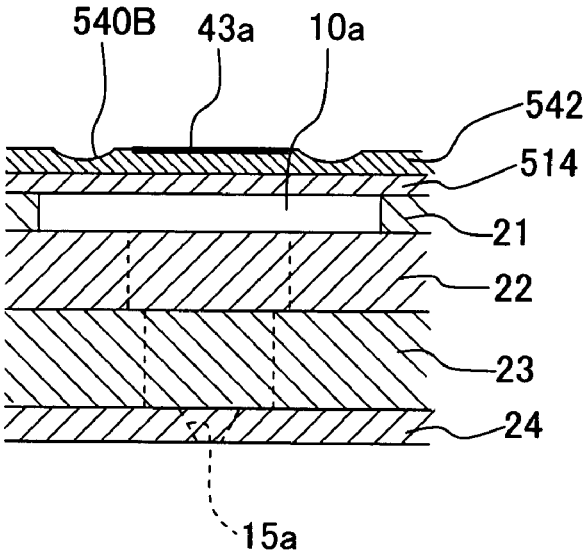
FIG. 20B shows a sectional view taken along a line XXB-XXB shown in FIG. 19A.
Figure 21:
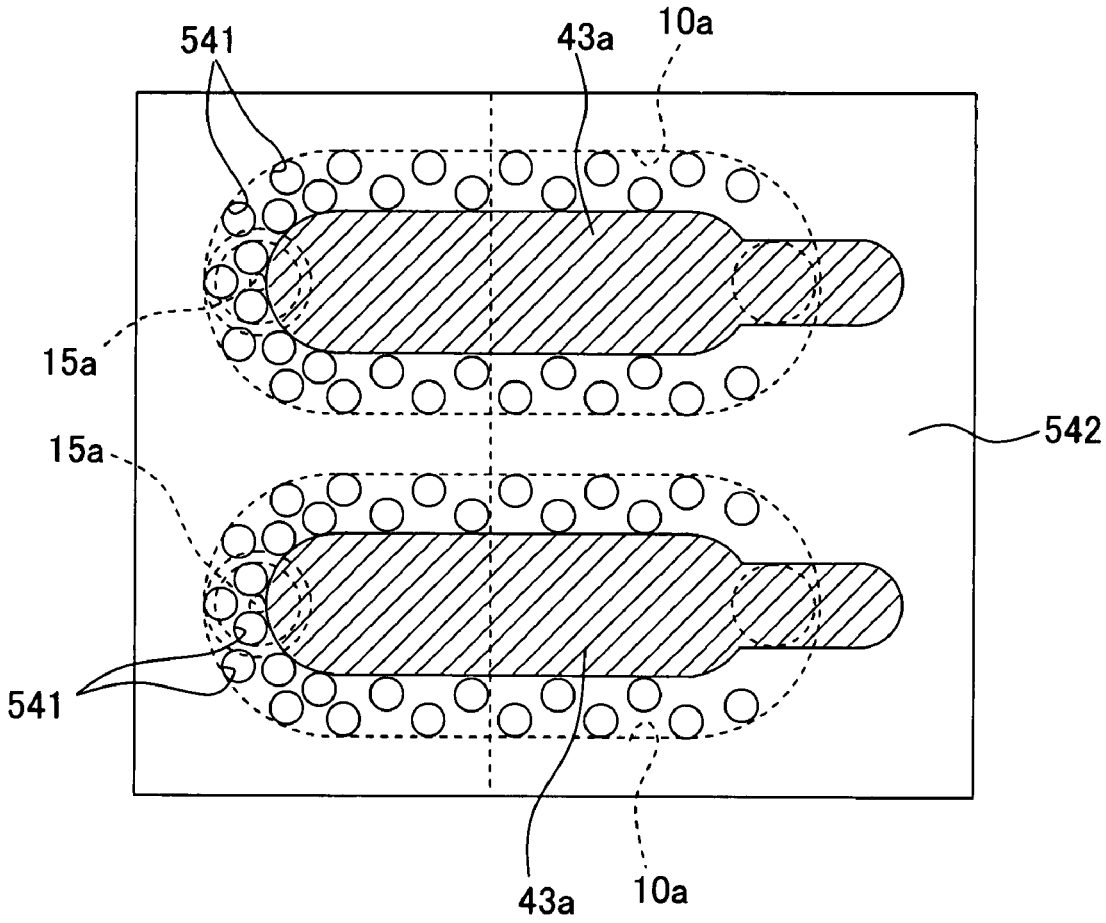
FIG. 21 shows a magnified view illustrating a third example of a eighth modification corresponding to FIG. 3.
Figure 22:
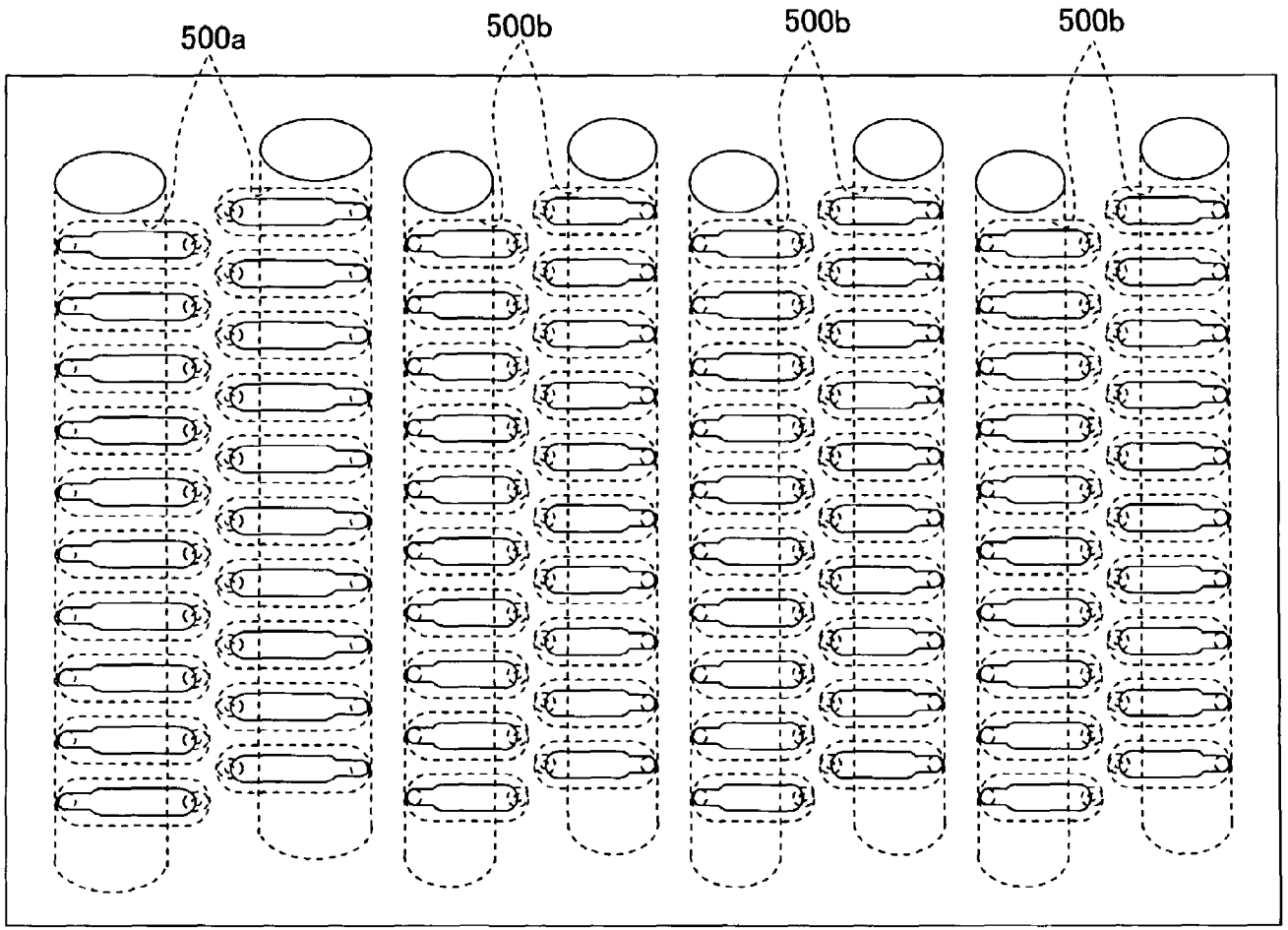
FIG. 22 shows a plan view illustrating a conventional liquid droplet jetting apparatus corresponding to FIG. 2.

As shown in FIGS. 19A and 19B, a recess 540A, which is substantially crescent-shaped as viewed in a plan view, may be formed in an area of a piezoelectric layer 542 overlapped with the end of the pressure chamber 10*a* in the longitudinal direction. Alternatively, as shown in FIGS. 20A and 20B, a first recess 540A may be formed in an area of a piezoelectric layer 542 overlapped with the end of the pressure chamber 10*a* in the longitudinal direction, and a second recess 540B, which is shallower than the first recess, may be formed in an area overlapped with an area of the outer edge of the pressure chamber 10*a* in the longitudinal direction. Further alternatively, recesses may be formed in an area of a vibration plate 514 overlapped with the end of the pressure chamber 10*a* in the longitudinal direction and/or an area overlapped with an area of the outer edge of the pressure chamber 10*a* in the longitudinal direction respectively, in addition to the piezoelectric layer 542 or in place of the piezoelectric layer 542. Further alternatively, as shown in FIG. 21, a plurality of holes 541 may be formed in an area of a piezoelectric layer 542 overlapped with the outer edge of the pressure chamber 10*a*. In any one of the arrangements described above, the rigidity of the portion of the piezoelectric actuator facing the area overlapped with the pressure chamber 10*a* can be lowered as compared with the rigidity of the portion facing the pressure chamber 10*b*. Accordingly, the volume of the black ink droplet jetted from the nozzle 15*a* can be made larger than the volume of the color ink droplet jetted from the nozzle 15*b* in the same manner as explained in the embodiment described above.

Ninth Modification

When the piezoelectric layer is formed, for example, by means of the sputtering method or the AD method as described above, the piezoelectric layer can be formed by using piezoelectric materials which are different between an area of the piezoelectric layer overlapped with the pressure chamber 10*a* and an area overlapped with the pressure chamber 10*b*. In this case, the rigidity of the piezoelectric material for forming the area of the piezoelectric layer overlapped with the pressure chamber 10*a* is made lower than the rigidity of the piezoelectric material for forming the area overlapped with the pressure chamber 10*b*. Accordingly, the rigidity of the portion of the piezoelectric actuator facing the area overlapped with the pressure chamber 10*a* can be lowered as compared with the rigidity of the portion facing the pressure chamber 10*b*. Accordingly, the volume of the black ink droplet jetted from the nozzle 15*a* can be made larger than the volume of the color ink droplet jetted from the nozzle 15*b* in the same manner as explained in the embodiment described above.

In the foregoing explanation, the thickness of the portion of one layer of the layers for constructing the piezoelectric actuator 31 (vibration plate 40, insulating layer 41, common electrode 44, individual electrodes 43*a*, 43*b*) facing the pressure chamber 10*a* is different from the thickness of the portion facing the pressure chamber 10*b*. However, two or more layers of the foregoing layers may be formed so that the thickness of the portion of each of them facing the pressure chamber 10*a* is different from the thickness of the portion facing the pressure chamber 10*b*.

In the embodiment of the present invention, the vibration plate 40 is joined to the upper surface of the channel unit 30, and then the insulating layer 41, the common electrode 44, the piezoelectric layer 42, and the individual electrodes 43*a*, 43*b* are formed on the upper surface of the vibration plate 40. In other words, the piezoelectric actuator-forming step is performed according to the present invention after the joining step is performed according to the present invention. On the contrary, the insulating layer 41, the common electrode 44, the piezoelectric layer 42, and the individual electrodes 43*a*, 43*b* may be formed on the upper surface of the vibration plate 40, and then the vibration plate 40 may be joined to the upper surface of the channel unit 30. In other words, the joining step may be performed according to the present invention after the piezoelectric actuator-forming step is performed according to the present invention.

In the embodiment of the present invention, the common electrode 44 is formed between the insulating layer 41 and the piezoelectric layer 42, and the individual electrodes 43*a*, 43*b* are formed on the upper surface of the piezoelectric layer 42. However, the individual electrodes 43*a*, 43*b* may be formed at the portions facing the pressure chambers 10*a*, 10*b* between the insulating layer 41 and the piezoelectric layer 42 respectively, and the common electrode 44 may be formed over the entire region of the upper surface of the piezoelectric layer 42.

In the embodiment of the present invention, the insulating layer 41 is formed on the upper surface of the vibration plate 40, and the common electrode 44 is formed on the upper surface of the insulating layer 41. When the vibration plate 40 is composed of the metal material, the following arrangement is also available. That is, the insulating layer 41 and the common electrode 44 are not formed independently, the vibration plate 40 is retained at the ground electric potential, and the vibration plate 40 also serves as the common electrode.

In the present invention, the ink droplets are jetted from the nozzles 15*a*, 15*b* by means of the pull type jetting operation. However, the push type jetting operation (pushing ejection) may be performed. When the push type jetting operation is performed, the individual electrodes 43*a*, 43*b* are previously retained at the ground electric potential, the driving electric potential is applied to the individual electrodes 43*a*, 43*b* to decrease the volumes of the pressure chambers 10*a*, 10*b*, and thus the pressures in the pressure chambers 10*a*, 10*b* are increased to jet the ink droplets from the nozzles 15*a*, 15*b*. The thickness of the piezoelectric layer 42 is thin at the portions facing the pressure chambers 10*a* as compared with the portions facing the pressure chambers 10*b*, and the rigidity is decreased. Therefore, also in the case of the push type jetting operation, the volume of the black ink droplet jetted from the nozzle 15*a* communicated with the pressure chamber 10*a* can be made larger than the volume of the color ink droplet jetted from the nozzle 15*b* communicated with the pressure chamber 10*b*.

In the embodiment of the present invention, the black ink droplets are jetted from the nozzles 15*a*, and the color ink droplets are jetted from the nozzles 15*b*. On the other hand, the following arrangement is also available. That is, a pigment ink is jetted from the nozzles 15*a*, and a dye ink is jetted from the nozzles 15*b*. In this case, the printing of the high image quality, in which any blur is scarcely caused, can be performed such that the pigment ink which scarcely causes the blur is jetted in the large volume from the nozzles 15*a*, and the dye ink which tends to cause the blur is jetted in the small volume from the nozzles 15*b*.

The foregoing description has been made about the example in which the present invention is applied to the ink-jet head for jetting the ink droplets from the nozzles 15*a*, 15*b*. However, the present invention is also applicable to any liquid droplet-jetting apparatus for jetting liquid droplets other than the ink droplets, including, for example, those of a chemical reagent, a biological solution, a wiring material solution, an electronic material solution, a liquid for refrigerant, and a liquid for fuel.

What is claimed is:

1. A liquid droplet-jetting apparatus which jets liquid droplets of a liquid, comprising:

a channel unit which is formed with a first channel including a first nozzle and a first pressure chamber communicated with the first nozzle and a second channel including a second nozzle and a second pressure chamber communicated with the second nozzle, the second channel having a same channel structure as that of the first channel; and a piezoelectric actuator which includes a vibration plate arranged on one surface of the channel unit while covering the first and second pressure chambers, a piezoelectric layer arranged to face the first and second pressure chambers on a surface of the vibration plate disposed on a side not facing the channel unit, and a pair of electrodes applying a voltage to the piezoelectric layer, and in which the vibration plate, the piezoelectric layer, and the electrodes are stacked, wherein a portion of one of the vibration plate, the piezoelectric layer, and the electrodes facing the first pressure chamber is thinner than a portion of the one of the vibration plate, the piezoelectric layer, and the electrodes facing the second pressure chamber.

2. The liquid droplet-jetting apparatus according to claim 1, wherein size of the liquid droplets jetted from the first nozzle is larger than size of the liquid droplets jetted from the second nozzle, the piezoelectric layer is contracted in a plane direction of the vibration plate to deform the vibration plate so that the vibration plate projects toward each of the first and second pressure chambers when the voltage is applied to the electrodes; and a pressure is applied to the liquid in each of the first and second pressure chambers to jet the liquid droplets.

3. The liquid droplet-jetting apparatus according to claim 2, wherein:

the first channel and the second channel include a plurality of first individual channels and a plurality of second individual channels respectively;

a plurality of the first pressure chambers form a first pressure chamber array arranged in a predetermined direction, and a plurality of the second pressure chambers form a second pressure chamber array arranged in the predetermined direction; and a portion of one of the vibration plate, the piezoelectric layer, and the electrodes facing the first pressure chamber array is thinner than another portion of one of the vibration plate, the piezoelectric layer, and the electrodes facing the second pressure chamber array.

4. The liquid droplet-jetting apparatus according to claim 2, wherein:

the liquid includes a black ink and a color ink; and droplets of the black ink are jetted from the first nozzle, and droplets of the color ink are jetted from the second nozzle.

5. The liquid droplet-jetting apparatus according to claim 2, wherein:

the liquid includes a pigment ink and a dye ink; and droplets of the pigment ink is jetted from the first nozzle, and droplets of the dye ink is jetted from the second nozzle.

6. The liquid droplet-jetting apparatus according to claim 2, wherein the portion of the piezoelectric layer facing the first pressure chamber is thinner than the another portion facing the second pressure chamber.

7. The liquid droplet-jetting apparatus according to claim 2, wherein the portion of the vibration plate facing the first pressure chamber is thinner than the another portion facing the second pressure chamber.

8. The liquid droplet-jetting apparatus according to claim 2, wherein:

the vibration plate is made of metal;

the piezoelectric actuator includes an insulating layer which is arranged on the surface of the vibration plate disposed on the side not facing the channel unit and which insulates the vibration plate from the electrodes; and a portion of the insulating layer facing the first pressure chamber is thinner than another portion of the insulating layer facing the second pressure chamber.

9. A method for producing a liquid droplet-jetting apparatus, the liquid droplet-jetting apparatus including: a channel unit which is formed with a first channel including a first nozzle and a first pressure chamber communicated with the first nozzle and a second channel including a second nozzle and a second pressure chamber communicated with the second nozzle, the second channel having a same channel structure as that of the first channel; and a piezoelectric actuator which includes a vibration plate arranged on a surface of the channel unit while covering the first and second pressure chambers, a piezoelectric layer arranged to face the first and second pressure chambers on a surface of the vibration plate disposed on a side not facing the channel unit, and a pair of electrodes applying a voltage to the piezoelectric layer, and in which the vibration plate, the piezoelectric layer, and the electrodes are stacked, the method comprising:

forming the channel unit so that the first channel has a same channel structure as that of the second channel;

forming the piezoelectric actuator by stacking the vibration plate, the piezoelectric layer, and the electrodes;

joining the vibration plate to the surface of the channel unit, wherein:

a portion of one of the vibration plate, the piezoelectric layer, and the electrodes facing the first pressure chamber is formed to be thinner than another portion of the one of the vibration plate, the piezoelectric layer, and the electrodes facing the second pressure chamber when the piezoelectric actuator is formed.

10. The method for producing the liquid droplet-jetting apparatus according to claim 9, wherein in the liquid droplet-jetting apparatus, liquid droplets of a liquid jetted from the first nozzle are larger than liquid droplets jetted from the second nozzle; the piezoelectric layer is contracted in a plane direction of the vibration plate to deform the vibration plate so that the vibration plate projects toward each of the first and second pressure chambers when the voltage is applied to the electrodes; and a pressure is applied to the liquid in each of the first and second pressure chambers to jet the liquid droplets.

11. The method for producing the liquid droplet-jetting apparatus according to claim 10, wherein one layer of the vibration plate, the piezoelectric layer, and the electrodes of the piezoelectric actuator is formed by a particle deposition method in which particles for constructing the one layer are deposited on a predetermined substrate when the piezoelectric actuator is formed.

12. The method for producing the liquid droplet-jetting apparatus according to claim 11, wherein the particle deposition method is an aerosol deposition method or a sputtering method.

13. The method for producing the liquid droplet-jetting apparatus according to claim 10, wherein:

the formation of the piezoelectric actuator includes formation of a recess on a surface of the vibration plate; and the vibration plate is joined to the surface of the channel unit so that the recess faces to the first pressure chamber when the vibration plate is joined to the channel unit.

14. A liquid droplet-jetting apparatus which jets liquid droplets of a liquid, comprising:

a channel unit which is formed with a first channel including a first nozzle and a first pressure chamber communicated with the first nozzle, and a second channel including a second nozzle and a second pressure chamber communicated with the second nozzle, the second channel having a same channel structure as that of the first channel; and a piezoelectric actuator which includes a vibration plate arranged on one surface of the channel unit while covering the first and second pressure chambers, a piezoelectric layer arranged, to face the first and second pressure chambers, on a surface of the vibration plate disposed on a side not facing the channel unit, and a pair of electrodes applying a voltage to the piezoelectric layer, and in which the vibration plate, the piezoelectric layer, and the electrodes are stacked;

wherein rigidity of a portion of the piezoelectric actuator facing the first pressure chamber is smaller than rigidity of another portion of the piezoelectric actuator facing the second pressure chamber.

15. The liquid droplet-jetting apparatus according to claim 14, wherein:

the first and second pressure chambers have substantially elliptical shapes which are long in a predetermined longitudinal direction; and a recess is formed at a portion, of one of the vibration plate and the piezoelectric layer, facing a substantially central portion of the first pressure chamber.

16. The liquid droplet-jetting apparatus according to claim 15, wherein a hollow space is formed in an area between the vibration plate and the piezoelectric layer, the area overlapping with the substantially central portion of the first pressure chamber.

17. The liquid droplet-jetting apparatus according to claim 16, wherein the hollow space is filled with a low rigidity material which has rigidity lower than those of the vibration plate and the piezoelectric layer.

18. The liquid droplet-jetting apparatus according to claim 15, wherein the pair of electrodes includes a ring-shaped electrode formed in an area, of the piezoelectric layer, overlapped with a peripheral portion of each of the first and second pressure chambers.

19. The liquid droplet-jetting apparatus according to claim 14, wherein:

the first and second pressure chambers have substantially elliptical shapes which are long in a predetermined longitudinal direction; and a groove is formed at a portion of one of the vibration plate and the piezoelectric layer facing a peripheral portion of the first pressure chamber.

20. The liquid droplet-jetting apparatus according to claim 19, wherein the groove is filled with a low rigidity material which has rigidity lower than those of the vibration plate and the piezoelectric layer.

21. The liquid droplet-jetting apparatus according to claim 19, wherein the groove is formed on only a side of one end, of one of the vibration plate and the piezoelectric layer, in the longitudinal direction of the first pressure chamber.

22. The liquid droplet-jetting apparatus according to claim 19, wherein the groove includes a first groove which is formed at an end, of one of the vibration plate and the piezoelectric layer, in the longitudinal direction of the first pressure chamber, and a second groove which is formed in the longitudinal direction of the pressure chamber; and the first groove is deeper than the second groove.

23. The liquid droplet-jetting apparatus according to claim 19, wherein a groove surrounding the first pressure chamber is formed on an area, of the vibration plate, outside an overlapping area at which the vibration plate overlaps with the pair of the electrodes.

24. The liquid droplet-jetting apparatus according to claim 14, wherein a portion, of the piezoelectric layer, facing the first pressure chamber is formed of a first piezoelectric material, another portion, of the piezoelectric layer, facing the second pressure chamber is formed of a second piezoelectric material which is different from the first piezoelectric material, and rigidity of the portion of the piezoelectric layer facing the first pressure chamber is lower than that of the another portion facing the second pressure chamber.

* * * * *